US012313359B2

(12) United States Patent
DeJessa

(10) Patent No.: US 12,313,359 B2
(45) Date of Patent: May 27, 2025

(54) EXPANSION-COMPRESSION BAFFLE

(71) Applicant: Smith & Wesson Inc., Springfield, MA (US)

(72) Inventor: Joe DeJessa, West Brookfield, MA (US)

(73) Assignee: Smith & Wesson Inc., Springfield, MA (US)

( * ) Notice: Subject to any disclaimer, the term of this patent is extended or adjusted under 35 U.S.C. 154(b) by 324 days.

(21) Appl. No.: 17/837,331

(22) Filed: Jun. 10, 2022

(65) Prior Publication Data

US 2022/0397361 A1 Dec. 15, 2022

Related U.S. Application Data

(60) Provisional application No. 63/209,670, filed on Jun. 11, 2021.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34
See application file for complete search history.

(56) References Cited

U.S. PATENT DOCUMENTS 3,385,164 A * 5/1968 Hubner ..... F41A 21/30 181/269
3,500,955 A * 3/1970 Werbell ..... F41A 21/30 181/223
5,029,512 A * 7/1991 Latka ..... F41A 21/30 89/14.4
7,237,467 B1 7/2007 Melton
7,308,967 B1 * 12/2007 Hoel ..... F41A 21/30 181/255
7,587,969 B2 * 9/2009 Silvers ..... F41A 21/30 42/1.06
7,600,606 B2 * 10/2009 Brittingham ..... F41A 21/30 89/14.3
8,167,084 B1 5/2012 Moore
8,490,535 B1 7/2013 Moore et al.
8,511,425 B2 8/2013 Larue
8,950,310 B2 2/2015 Storrs et al.
(Continued)

*Primary Examiner* — Edgardo San Martin
(74) *Attorney, Agent, or Firm* — Stinson LLP

(57) ABSTRACT

A suppressor baffle and a suppressor for a firearm. The suppressor includes a firearm attachment portion, a sleeve portion, and a baffle assembly with a plurality of baffles. At least one of the baffles includes a tubular body with a proximal exterior surface. The proximal exterior surface has a plurality of spaced-apart annular ridges. A first annular ridge includes a first annular compression surface and a first annular expansion surface, and a second annular ridge includes a second annular compression surface. The ridges are shaped and arranged to define a convex first expansion corner between the first annular compression surface and the first annular expansion surface, and a concave first compression corner between the first annular expansion surface and the second annular compression surface. Gas flowing along the proximal exterior surface expands at the first expansion corner and compresses at the first compression corner to dissipate energy in the gas.

22 Claims, 28 Drawing Sheets

(56) References Cited

U.S. PATENT DOCUMENTS

| | | | | |
|---|---|---|---|---|
| 8,991,550 | B2 | 3/2015 | Coley | |
| 8,991,551 | B2 * | 3/2015 | Latka | F41A 21/30 89/14.4 |
| 9,182,188 | B2 * | 11/2015 | Gawencki | F41A 21/30 |
| 9,410,761 | B2 * | 8/2016 | Morris | F41A 21/30 |
| 9,500,426 | B2 * | 11/2016 | Salvador | F41A 21/30 |
| 9,593,899 | B2 * | 3/2017 | Coppinger | F41A 21/30 |
| 10,254,068 | B2 | 4/2019 | Piemme et al. | |
| 11,561,059 | B2 * | 1/2023 | Reis-Green | F41A 21/30 |
| 11,927,411 | B2 * | 3/2024 | DeJessa | F41A 21/30 |
| 2014/0224574 | A1 * | 8/2014 | Latka | F41A 21/30 181/223 |
| 2021/0254920 | A1 * | 8/2021 | Miller | F41A 21/30 |
| 2022/0397362 | A1 * | 12/2022 | DeJessa | F41A 21/30 |
| 2022/0397363 | A1 * | 12/2022 | DeJessa | F41A 21/30 |
| 2022/0397364 | A1 * | 12/2022 | DeJessa | F41A 21/30 |

* cited by examiner

EXPANSION-COMPRESSION BAFFLE

FIELD OF THE INVENTION

This disclosure relates generally to a suppressor for suppressing a blast of a firearm and to baffles of the suppressor that have energy-dissipating surfaces.

BACKGROUND OF THE INVENTION

Suppressors are used to suppress the blast of a firearm. A typical suppressor is mounted on the distal end of the firearm and defines a projectile passage extending along an axis. The projectile passage is aligned with the firearm so that the fired round travels through the projectile passage after exiting a muzzle of the firearm. A sleeve typically encloses the projectile passage, and one or more baffle walls extend inward from the sleeve and around the projectile passage. The baffle walls are oriented transverse to the axis of the projectile passage to define expansion chambers in fluid communication with the projectile passage. At least some of the exhaust gas associated with the fired round expands radially into the expansion chambers. The baffles thereby entrap and slow some of the exhaust gas so that the exhaust gas exits the suppressor at a lower velocity than it would have exited the muzzle of the firearm if no suppressor were used. The suppressor thereby reduces the energy of the exhaust gas to reduce the report (i.e., suppress the sound) of the round.

One type of suppressor includes a sleeve, a fitting on a proximal end of the sleeve, a plurality of baffles stacked together and at least partially received inside the interior volume of the sleeve, and an end cap assembly secured to at least the most distally positioned baffle. A projectile passage passes through the baffles and the end cap. Each baffle has a body with an angled portion on its proximal side and a cylindrical portion on its distal side. When the baffles are stacked together, the cylindrical portion of each but the most distally positioned baffle engages an adjacent baffle to maintain spacing relative to the adjacent baffle. The sleeve, the baffles, and the end cap define a plurality of expansion chambers along the length of the suppressor. The chambers direct some of the exhaust gas away from the projectile passage, reducing the velocity at which the exhaust gas exits the suppressor and thereby reducing the report of the round.

BRIEF SUMMARY OF THE INVENTION

In one aspect of the present invention, a baffle for a firearm suppressor includes a tubular body with a central axis. The tubular body is sized and shaped for receiving a bullet along the central axis from a proximal end of the tubular body to a distal end of the tubular body. The tubular body includes a proximal exterior surface and a plurality of annular ridges on the proximal exterior surface. The annular ridges are spaced apart from each other in a direction along the central axis of the tubular body. A first of the ridges has a first annular compression surface and a first annular expansion surface, each having a proximal end and a distal end. The first annular compression surface angles away from the central axis at an angle skew to the central axis as the first annular compression surface extends from its proximal end to its distal end. The first annular expansion surface extends from its proximal end to its distal end, and the proximal end of the first annular expansion surface and the distal end of the first annular compression surface at least partially define a first expansion corner. An exterior angle between the first annular compression surface and the first annular expansion surface at the first expansion corner is greater than 180°. A second of the ridges has a second annular compression surface having a proximal end and a distal end. The proximal end of the second annular compression surface and the distal end of the first annular expansion surface at least partially define a first compression corner. An exterior angle between the second annular compression surface and the first annular expansion surface at the first compression corner is less than 180°. Gas flowing along the proximal exterior surface of the tubular body is expanded at the first expansion corner and compressed at the first compression corner to dissipate energy in the flowing gas.

In another aspect of the present invention, a suppressor for a firearm has an attachment portion, a sleeve, and a baffle assembly. The attachment portion is configured for releasably attaching the suppressor to the firearm. The sleeve is supported by the attachment portion and extends distally from the attachment portion. The sleeve further defines an internal volume. The baffle assembly includes a plurality of baffles and is at least partially received in the internal volume of the sleeve. The baffles are arranged one after another in the baffle assembly. Each baffle includes a tubular body with a central axis. The tubular body is sized and shaped for receiving a bullet through the central axis from a proximal end of the tubular body to a distal end of the tubular body. The tubular body of at least one of the baffles includes a proximal exterior surface and a plurality of annular ridges located on the proximal exterior surface. The annular ridges are spaced apart from each other in a direction along the central axis of the tubular body. A first of the ridges has a first annular compression surface and a first annular expansion surface, each having a proximal end and a distal end. The first annular compression surface angles away from the central axis at an angle skew to the central axis as the first annular compression surface extends from its proximal end to its distal end. The first annular expansion surface extends from its proximal end to its distal end, and the proximal end of the first annular expansion surface and the distal end of the first annular compression surface at least partially define a first expansion corner. An exterior angle between the first annular compression surface and the first annular expansion surface about the first expansion corner is greater than 180°. A second of the ridges has a second compression surface and a second expansion surface, each extending from a proximal end to a distal end. The proximal end of the second annular compression surface and the distal end of the first annular expansion surface at least partially define a first compression corner. An exterior angle between the second annular compression surface and the first annular expansion surface about the first compression corner is less than 180°. Gas flowing along the proximal exterior surface of the tubular body of said at least one baffle is expanded at the first expansion corner and compressed at the first compression corner to dissipate energy in the flowing gas.

Other objects and features will be in part apparent and in part pointed out hereinafter.

BRIEF DESCRIPTION OF THE SEVERAL VIEWS OF THE DRAWING

Corresponding reference characters indicate corresponding parts throughout the drawings.

DETAILED DESCRIPTION OF THE INVENTION

Figure 1:
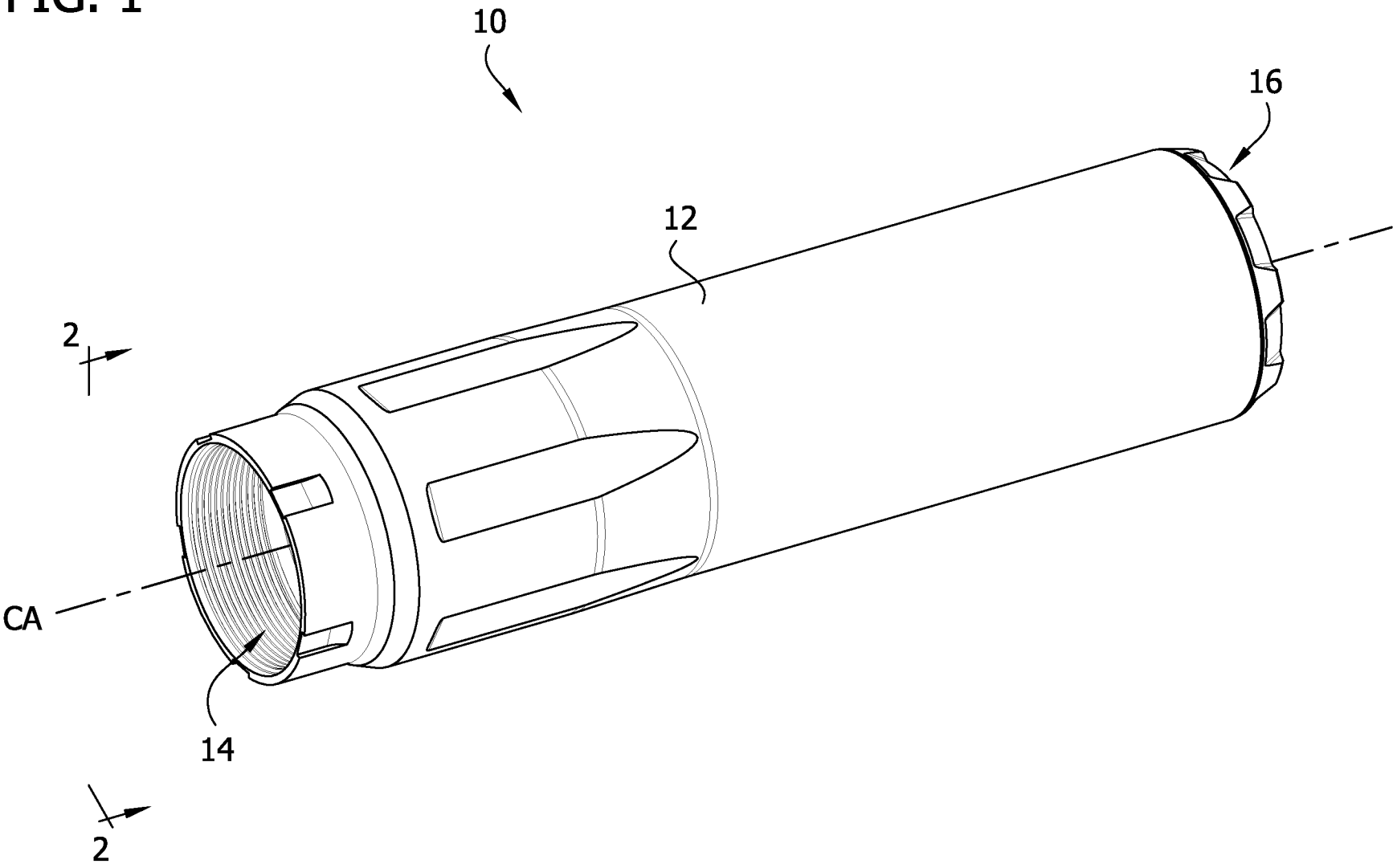
FIG. 1 is a perspective of a suppressor for a firearm.

Referring to FIGS. 1-4, a firearm suppressor of the present disclosure is indicated generally by reference number 10. The suppressor 10 has a proximal end and a distal end spaced apart along a central axis CA of the suppressor. A tubular sleeve, generally indicated at 12, extends along the axis CA of the suppressor 10 from the proximal end to the distal end of the suppressor 10. A muzzle fitting, generally indicated at 14, defines the proximal (or "inlet") end of the suppressor and is integral to the sleeve 10. An end cap assembly, generally indicated at 16, includes an end cap holder, generally indicated at 18, and an end cap, generally indicated at 20. The end cap assembly 16 defines the distal (or "outlet") end of the suppressor 10. A baffle assembly, generally indicated at 22, includes a blast baffle, generally indicated at 24; a plurality of standard baffles, generally indicated at 26; and an end baffle, generally indicated at 28. For purposes of this description, the baffle assembly may be broadly considered "fluid pressure dissipating structure." The baffles 24, 26, 28 are stacked along the axis CA of the suppressor 10 and secured to one another. The baffle assembly 22 is received within sleeve 12, as will be explained in greater detail below. The sleeve 12 and the end baffle 28 are configured to jointly receive end cap assembly 16. The sleeve 12, the fitting 14, the baffle assembly 22, and the end cap assembly 16 define a projectile passage 30 extending along the central axis CA from the proximal end through the distal end of the suppressor 10. As explained below, the suppressor 10 is configured to be removably mounted on a firearm (not shown) so that rounds fired from the firearm travel along the central axis CA through the projectile passage 30. The suppressor 10 receives exhaust gas associated with the round in chambers 32, 34, 36, 38 and peripheral channels 40. The chambers 32, 34, 36, 38 are defined between the fitting 14, the sleeve 12, the baffles 24, 26, 28 of baffle assembly 22, and the end cap assembly 16, as described below. Likewise, the peripheral channels 40 are defined between the sleeve 12 and the exterior of baffle assembly 22, as described below. The suppressor 10 thereby slows the velocity of the blast gas associated with the round to reduce the report and the flash signature of the round. As will be explained below, the suppressor 10 includes features which improve suppression performance. Below, the disclosure first separately describes each of the components of the suppressor 10, before describing the manufacture, assembly, and use of the suppressor in greater detail. Although aspects of the present disclosure have particular application to suppressors, it will be understood that the present invention may also be applied generally to firearm accessories. For example, certain features suppress the flash of a fired round independently of sound suppression.

Figure 3:
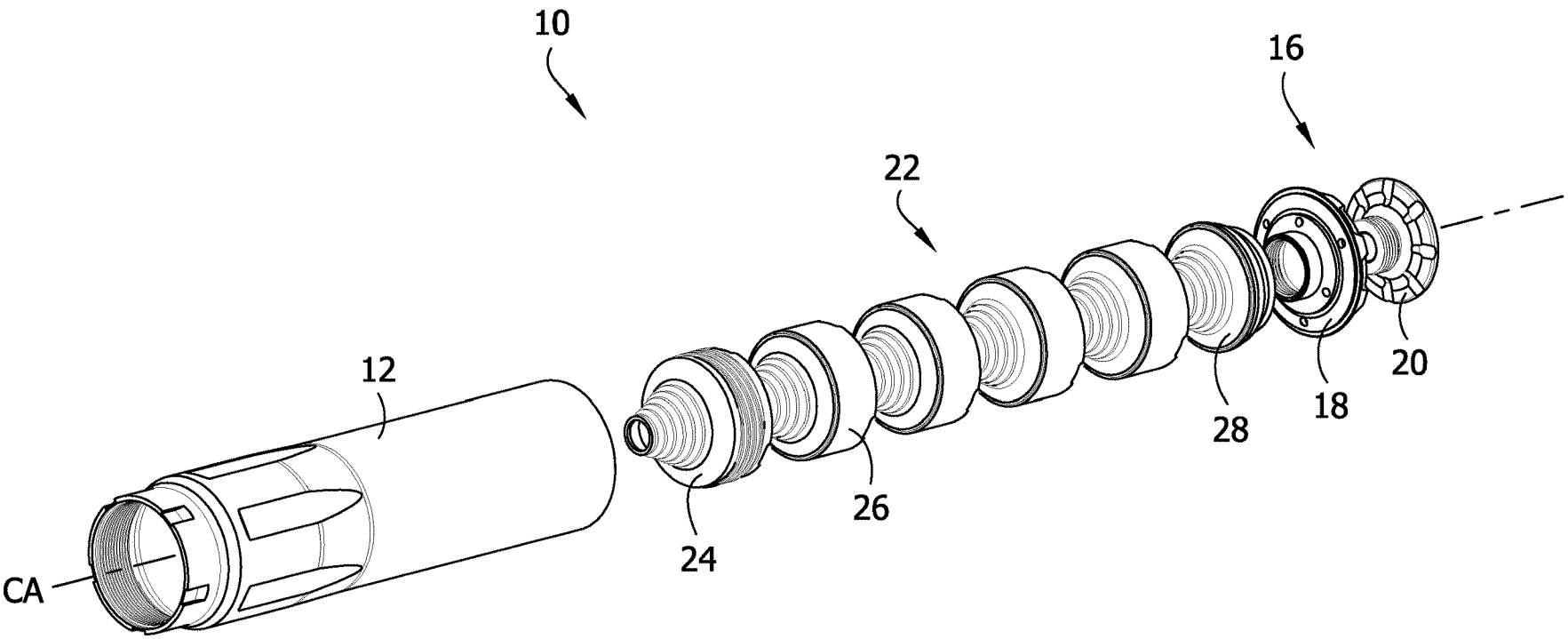
FIG. 3 is the perspective of FIG. 1 with the elements of the suppressor exploded.
Figure 5:
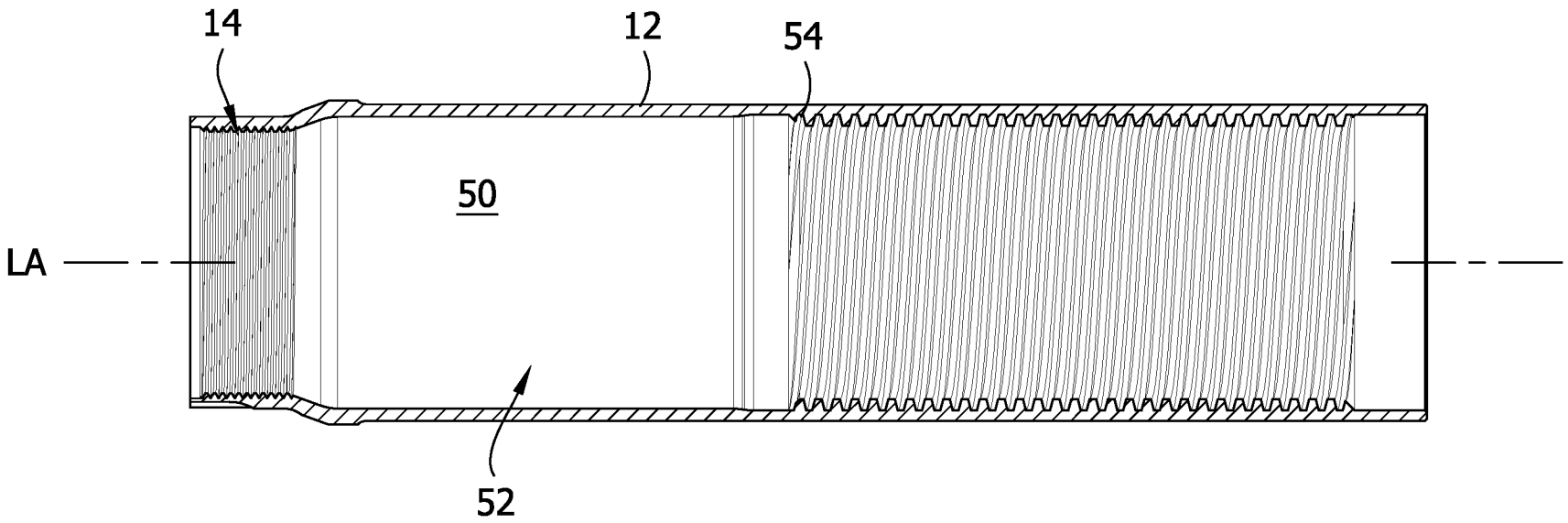
FIG. 5 is a longitudinal section of the sleeve of the suppressor of FIGS. 1-4.

Referring to FIG. 5, the sleeve 12 has an axis LA and proximal and distal ends spaced apart along the axis. In the illustrated suppressor 10, the axis LA of the sleeve 12 is coincident with the central axis CA of the suppressor. In one or more embodiments, the sleeve is formed from a single piece of machined metal stock (e.g., stainless steel) or other suitable material. The sleeve 12 has a tubular wall 50 extending from the proximal end to the distal end of the sleeve along axis LA. An internal volume 52 is defined in the region generally surrounded by the wall 50. As described above, the fitting 14 is integral to the sleeve 12 on the sleeve's proximal end. The fitting 14 is configured to be connected to the muzzle of a firearm. In use, the fitting 14 secures the suppressor 10 to the muzzle of the firearm to operatively align the muzzle of the firearm with the projectile passage 30 of the suppressor. Any suitable type of fitting may be used without departing from the scope of the invention. As seen in FIG. 3, a portion of the exterior surface of sleeve 12 near the proximal end includes a plurality of wrench flats. Referring again to FIG. 5, a portion of the interior surface of wall 50 near the proximal end of sleeve 12 includes a threaded portion forming part of the fitting. It is contemplated that a user may mount the suppressor 10 to a corresponding mounting portion of the muzzle of the firearm using a wrench that corresponds to the size and spacing of the wrench flats.

Figure 2:
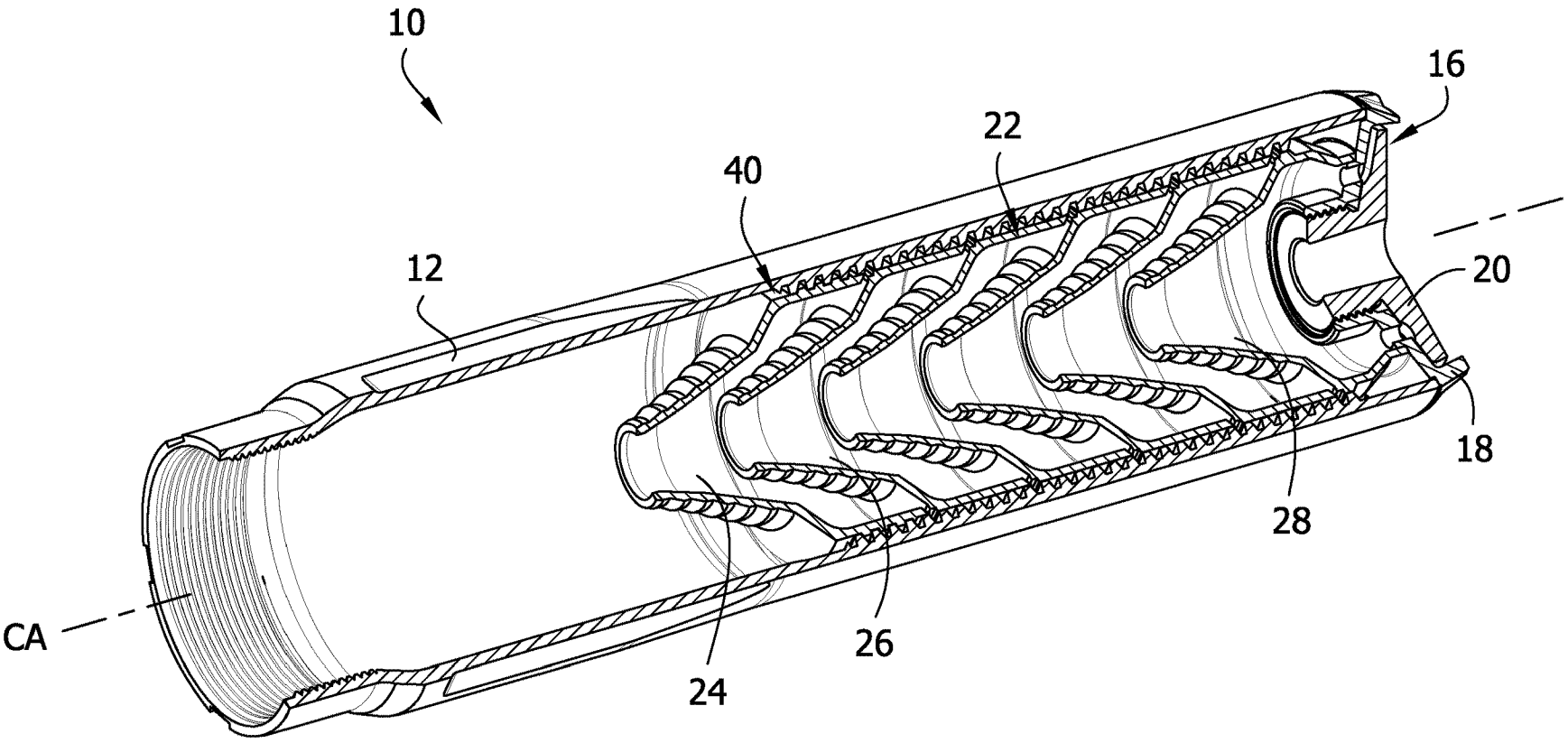
FIG. 2 is an angled section taken in the region defined by line 2-2 of FIG. 1.
Figure 4:
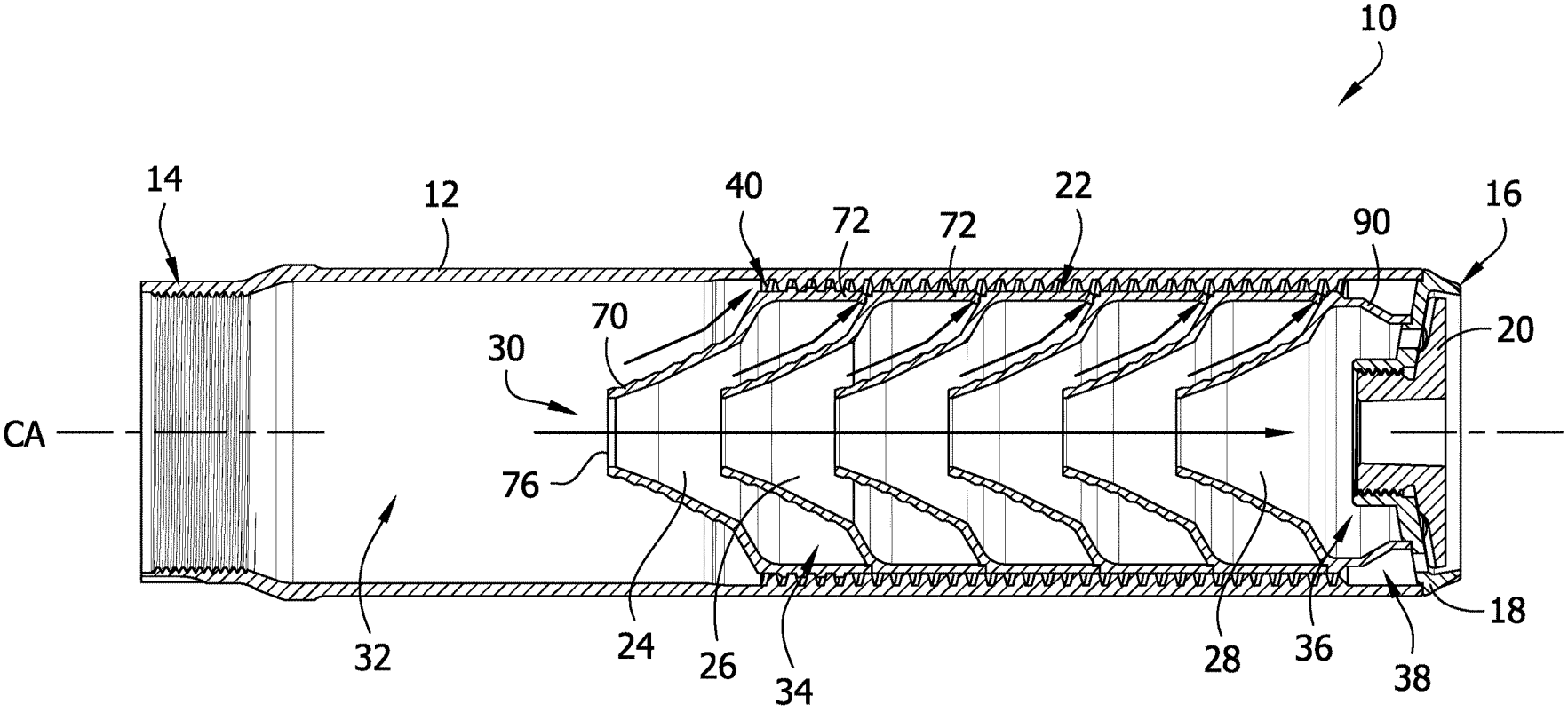
FIG. 4 is a longitudinal section of the suppressor of FIG. 1.
Figure 6:
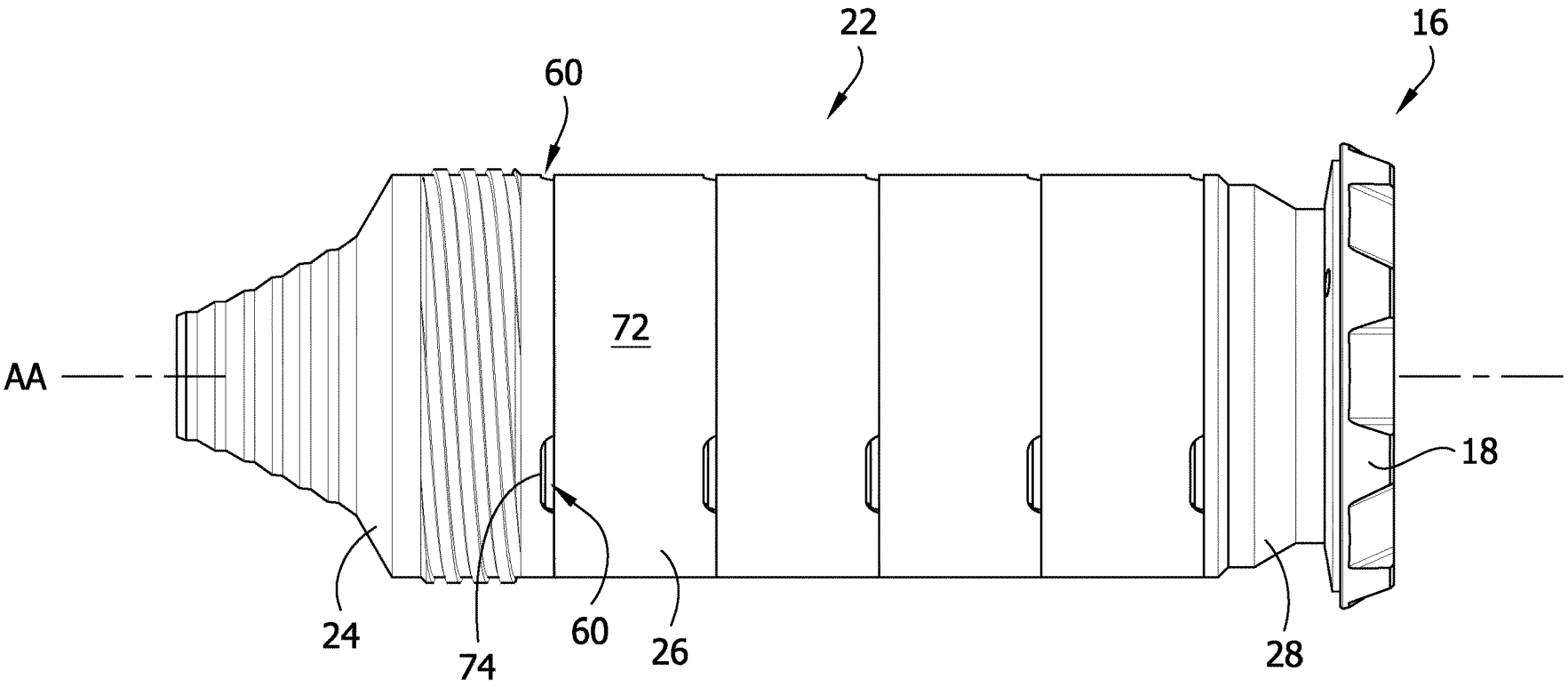
FIG. 6 is a side view of the baffle assembly and the end cap assembly of the suppressor of FIGS. 1-4.

Referring still to FIG. 5, the interior surface of wall 50 includes a plurality of grooves 54 which extend helically over approximately half of the span of sleeve 12 toward the sleeve's distal end. It will be appreciated that the grooves 54 extend over a distance that generally corresponds to the length of the exterior of baffle assembly 22, as will be described in more detail below, to define with the baffle assembly 22 a plurality of helical peripheral channels 40, as generally shown in FIGS. 2 and 4. As will be described in further detail below, it will also be appreciated that the pitch of the grooves 54 corresponds to the spacing between baffle ports 60 located in an exterior wall of the baffle assembly 22. As shown in the illustrated embodiment, the sleeve 12 has three interleaved grooves 54, thereby defining three, distinct peripheral channels 40 in suppressor 10 (FIGS. 2, 4). Generally speaking, the flow in each of the grooves is isolated from the flow in the other two grooves. Each of the grooves 54 revolves around the sleeve 12 twice over the distance between successive baffle ports 60 in baffle assembly 22 (FIG. 6). Of course, it is contemplated that the grooves 54 can be configured to have a different start or pitch, or a different path across the sleeve 12 in alternative embodiments. Referring again to FIGS. 2 and 4, the grooves 54 in the present embodiment are further configured to receive a threaded interface 78 of the blast baffle 24, which will be described in further detail below (FIGS. 7-8), so that the blast baffle—and the remainder of the baffle assembly 22 assembled thereto—can be retained within the sleeve 12. While the threaded interface 78 is configured to occupy an outer portion of the peripheral channels 40 when received by the groves 54, it will be appreciated that a remaining inner portion of the peripheral channels 40 (i.e., the portions nearest the bottoms of the channels) will remain open to receive exhaust gas from the firearm over the span of threaded interface 78.

In one or more embodiments, the length of sleeve 12 and/or the span of grooves 54 can vary to accommodate baffle assemblies 22 of different sizes and to adjust the size of the entrance chamber 32, which is described in further detail below.

Referring to FIGS. 2-4 and 6, the baffle assembly 22 includes the blast baffle 24, a plurality of standard baffles 26, and an end baffle 28. The baffles 24, 26, 28 are stacked one after another along a baffle assembly axis AA, which is coincident with the central axis CA of the suppressor. The baffle assembly 22 partially defines the projectile passage 30 of the suppressor 10 through a baffle bore 76 in each of the baffles 24, 26, 28. The exterior of the baffle assembly 22 is generally defined by the proximal baffle wall 70 and the distal baffle wall 72 of the blast baffle 24, the distal baffle walls 72 of each of the standard baffles 26, and the distal wall 90 of the end baffle 28. Further details about the features of each of the baffles 24, 26, 28 will be described below. It is contemplated that the baffles 24, 26, 28 may be secured together by welds or any other suitable method, or they may rest unfixed, against one another. Located within the exterior of the baffle assembly 22 are several baffle ports 60, which are defined by small gaps between successive baffles 24, 26, 28 when the baffles are stacked. Specifically, each baffle port 60 is defined by a peripheral recess 74 at a distal end of the distal baffle wall 72 of a proximally positioned baffle and a proximal end of the distal baffle wall 72 of a distally positioned standard baffle 26 (or proximal end of the distal wall 90 of end baffle 28). Further details about the distal baffle walls 72 of the baffles 24, 26 and the peripheral recesses 74 located in each distal baffle wall will be described below. It will be appreciated that most features of the baffles 24, 26, 28 are substantially identical. Therefore, blast baffle 24 will be described in substantial detail below, and differences in the standard baffles 26 and end baffle 28 will be described in reference to blast baffle 24.

Figure 7:
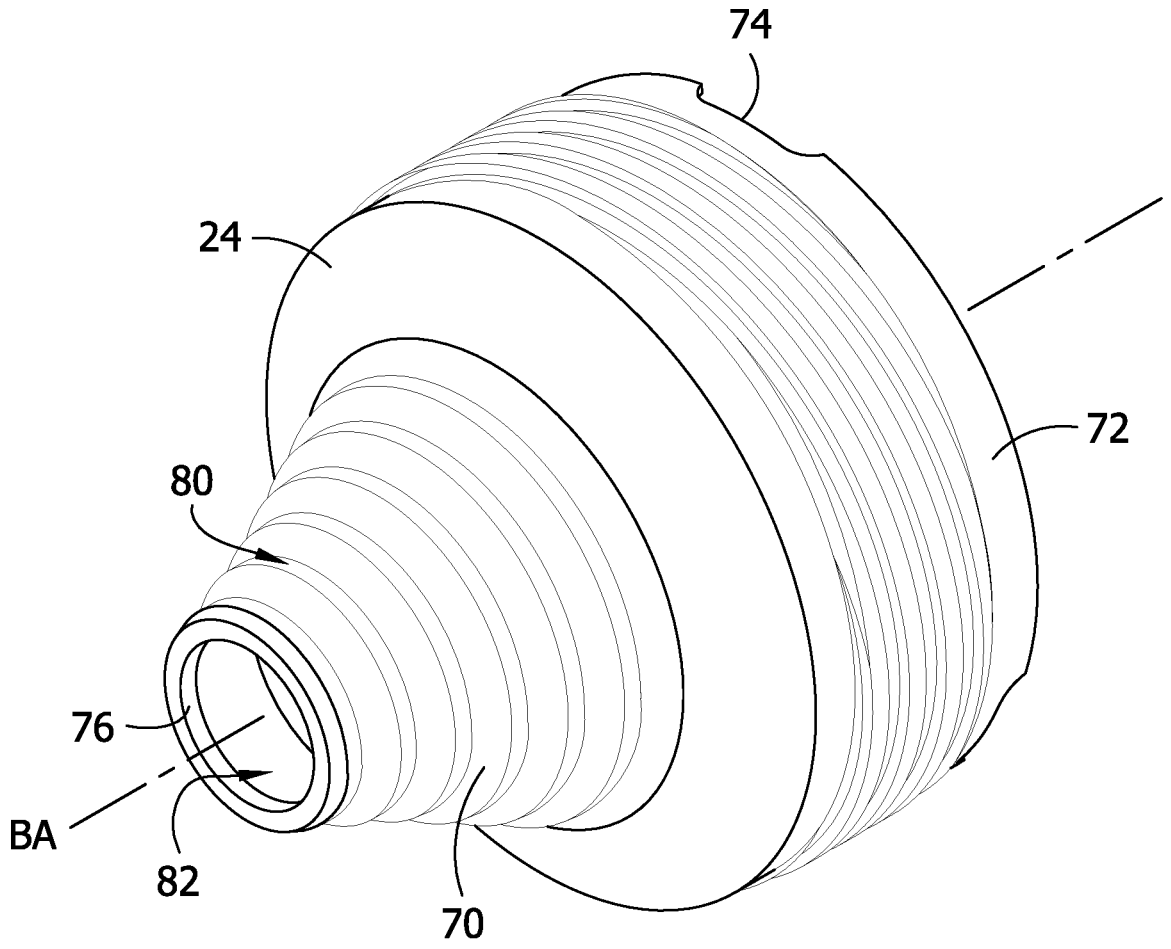
FIG. 7 is a perspective of the blast baffle of the suppressor of FIGS. 1-4.
Figure 8:
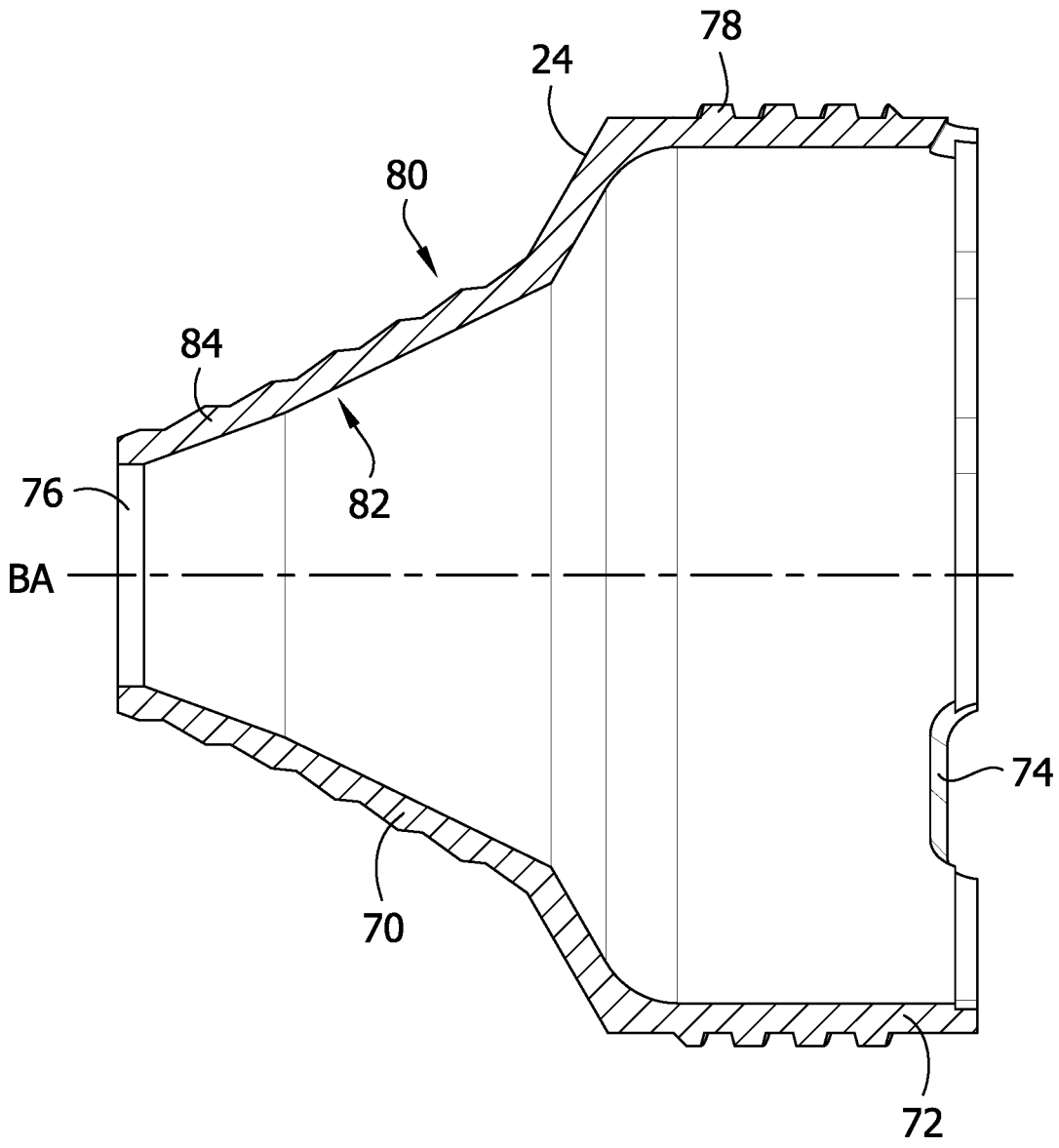
FIG. 8 is a section of the blast baffle of FIG. 7 taken in the plane including line 8-8.
Figure 9:
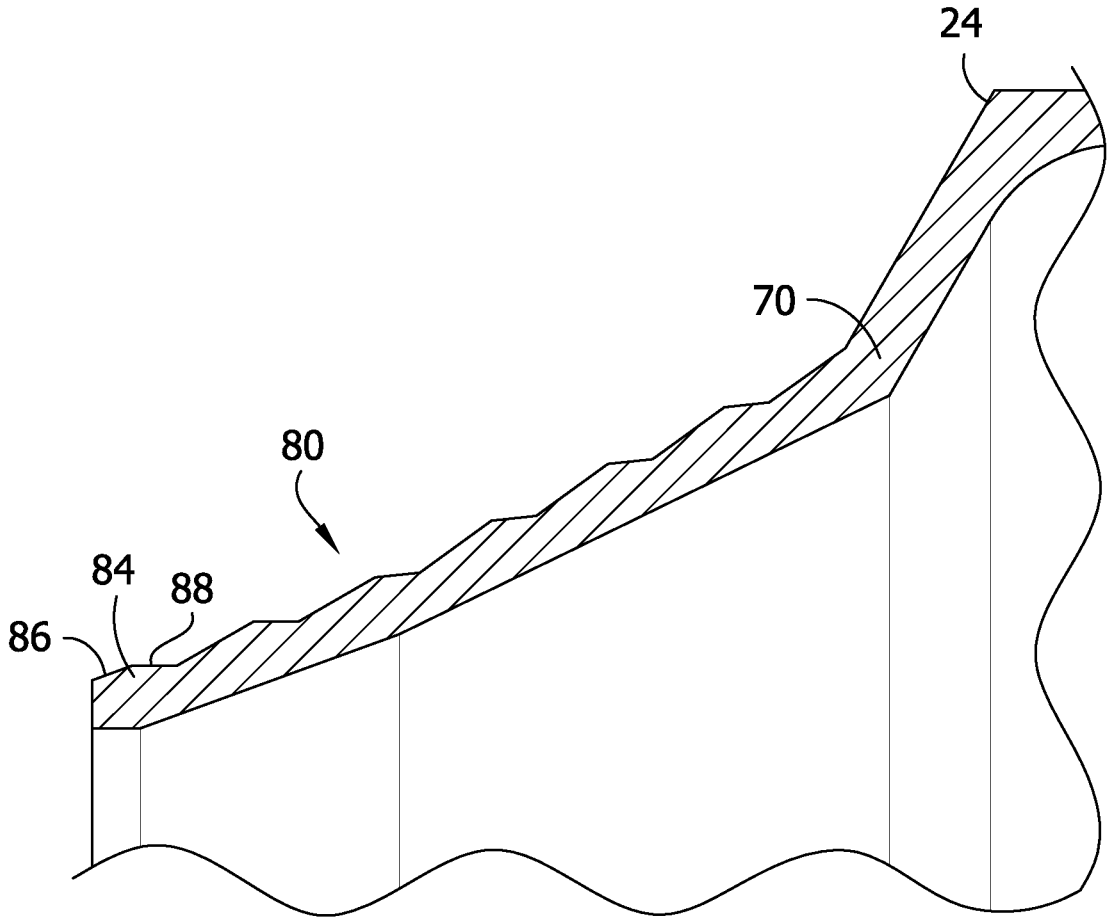
FIG. 9 is an enlarged fragment of the section of FIG. 8.

Referring to FIGS. 7-9, when the blast baffle 24 is received by the sleeve 12 and stacked adjacent a proximal standard baffle 26, the blast baffle is generally arranged to define an entrance chamber 32 within the internal volume 52 of the sleeve as well as a baffle chamber 34 between the blast baffle and the adjacent standard baffle and opposite the entrance chamber (FIGS. 2, 4). In one or more embodiments, the blast baffle 24 is formed from a single piece of machined metal stock (e.g., stainless steel). The blast baffle 24 has an axis BA and proximal and distal ends spaced apart along the axis. In the illustrated suppressor 10, the axis BA of the blast baffle 24 is coincident with the axis AA of the baffle assembly 22 and the central axis CA of the suppressor. The blast baffle 24 has a proximal baffle wall 70 extending generally around the axis BA and extending distally from the proximal end of the baffle. The illustrated proximal baffle wall 70 is generally conical, though other baffles may have baffle walls with other shapes without departing from the scope of the invention. The proximal baffle wall 70 has a cone axis coincident with baffle axis BA and a proximal end portion and a distal end portion spaced apart from one another along the cone axis. A diameter of the proximal baffle wall 70 increases as the proximal baffle wall extends from adjacent the proximal end portion toward the distal end portion. The proximal baffle wall 70 has a proximal exterior surface 80 that faces radially outwardly and proximally as well as a proximal interior surface 82 that faces radially inwardly and distally (the specific structure and function of the proximal exterior surface 80 will be described in greater detail below). The proximal interior surface 82 defines a baffle bore 76 around the axis BA at the proximal end portion of the proximal baffle wall 70 and an interior conical volume that extends along the axis BA between the baffle bore and the distal end portion of the proximal baffle wall. The baffle bore 76 forms a part of the projectile passage 30 when the suppressor 10 is assembled.

A distal baffle wall 72 of the blast baffle 24 extends along the axis BA from the distal end portion of the proximal baffle wall 70 to the distal end of the blast baffle. Thus, a diameter of the distal baffle wall 72 is equal to the diameter of the proximal baffle wall 70 at its distal end portion. The diameter of the distal baffle wall 72 corresponds with the grooves 54 of sleeve 12 such that the exterior of the baffle assembly 22 and the grooves generally define the peripheral channels 40, as discussed above in connection with FIGS. 2 and 4. Additionally, a threaded interface 78 protrudes outward from an exterior surface of the distal baffle wall 72. As described previously in connection with FIGS. 2 and 4, the threaded interface 78 is configured to be received by the grooves 54 of the sleeve 12. Thus, the threaded interface 78 is shaped and dimensioned to correspond to the shape and dimensions of the grooves 54 (FIG. 5). In the illustrated embodiment, the threaded interface 78 has three helical ridges which revolve around a portion of the exterior surface of the distal baffle wall 72 at a pitch corresponding to the pitch of the grooves 54. In one embodiment, the baffle assembly is formed by stacking and connecting (e.g., as by welding) the baffles together. The end cap assembly 16 is similarly attached to the end baffle 28 to produce the unit shown in FIG. 6. This unit can be inserted into the sleeve 12 to engage the threaded interface of the blast baffle with the helical grooves on the interior of the sleeve. The unit is screwed down until it bottoms out. In this position, the end cap holder is urged tightly against the sleeve for an essentially sealing connection with the sleeve.

Referring now to FIGS. 8 and 9, in the illustrated embodiment, the proximal exterior surface 80 includes a plurality of ridges 84 which extend distally over a portion of the proximal exterior surface starting at the proximal end portion of the proximal baffle wall. Each ridge 84 has an annular compression surface 86 located on a proximal side of the ridge and an annular expansion surface 88 located on a distal side. Each annular compression surface 86 extends from a proximal end to a distal end at a skew angle with respect to the baffle axis BA. The slope of the angle of each annular compression surface 86 is greater than a slope of the proximal baffle wall 70 at a corresponding location along the proximal exterior surface 80. Thus, each annular compression surface 86 projects outward from the proximal baffle wall 70 and defines a peak in the respective ridge 84 at the distal end of the annular compression surface. An annular expansion surface 88 is located distally adjacent each annular compression surface 86 of a corresponding ridge 84. Each annular expansion surface 88 extends from a proximal end (corresponding to the distal end of the preceding annular compression surface 86) to a distal end. In contrast to the annular compression surfaces 86, each annular expansion surface 88 has a slope that is less than the slope of the proximal baffle wall 70 at the corresponding location. Thus, each annular expansion surface 88 recedes into the proximal baffle wall 70 and defines a valley at the distal end of the annular expansion surface. It will therefore be appreciated that, at each peak (an "expansion corner") where a proximally located annular compression surface 86 meets a distally located annular expansion surface 88, a convex (greater than 180°) angle is formed externally between the annular compression surface and the annular expansion surface. Similarly, at each valley (a "compression corner") where a proximally located annular expansion surface 88 meets a distally located annular compression surface 86, a concave (less than 180°) angle is formed externally between the annular expansion surface and the annular compression surface.

As high-speed and high-pressure exhaust gas travels over proximal exterior surface 80, the alternating convex ("expansion") and concave ("compression") corners defined by the ridges 24 generate a sequence of separation shocks and reattachment shocks which dissipate energy in the gas by sequentially reducing pressure and introducing turbulence to the flow.

The Prandtl-Meyer formulas, which are known in the art, provide an idealized model of the effects that the convex corners of the ridges 84 have on the flow of the high-pressure exhaust gas. When a supersonic flow encounters a convex corner, it will form an expansion fan consisting of an infinite number of expansion waves GO which project radially outward from the convex corner. It is understood that the incoming Mach number ($M_1$) of the supersonic flow and the turn angle ($\theta$) of the convex corner will dictate the outgoing Mach number ($M_2$) of the supersonic flow following the corner. It is further understood that the speed of the supersonic flow will increase after bending around the convex corner, and the pressure of the gas will drop as a consequence.

In addition, when the angle of the convex corner exceeds a critical angle ($\theta_{max}$) associated with a supersonic flow of a given Mach number, the flow will only deflect as far as the critical angle and will separate from the expansion surface 88, causing stagnation in the region between the expansion surface and the boundary of the deflected flow. It will be appreciated that viscosity in the gas may lead to turbulence near the boundary between the deflected flow and the stagnant region, which will result in energy dissipation in addition to the reduction in pressure due to the general expansion discussed herein. It is generally understood that the flow rate of exhaust gas leaving the muzzle of a firearm can range from a Mach number of around 2.5 to a Mach number greater than 4, and the above principles are known to be operative at Mach numbers ranging from 1 to 15. Further, it is understood that gas having a higher Mach number will be associated with a smaller critical angle for deflection/separation.

A different energy-dissipating effect that is generally known in the art occurs when a supersonic flow passes over a concave corner following a ridge 84. In this case, the high-speed, high-pressure gas encounters compression surface 86 immediately past the concave corner, which will result in the formation of a separation shock ahead of the concave corner and a reattachment shock following the concave corner. Following reattachment, the exhaust gas will proceed generally parallel to the annular compression surface 86 at a relatively high pressure. It will be appreciated that turbulence is generated where the flow separates from the concave corner, resulting in energy dissipation. It will further be appreciated that the boundary layer of the flow following reattachment is relatively narrow, which makes the flow suitable for expansion at a subsequent convex corner.

Returning to FIGS. 8-9, it will be understood that the above-described expansion and compression effects will occur in sequence as the exhaust gas passes over the series of ridges 84 along proximal exterior surface 80. Thus, the proximal exterior surface 80 will cause substantial energy dissipation along its full extent.

In the illustrated embodiment, the proximal exterior surface 80 includes six ridges 84 positioned adjacent one another, between 0.095" and 0.102" apart, beginning at the proximal end portion of the proximal baffle wall 70. It is contemplated that in other embodiments, the proximal exterior surface 80 can have as few as one ridge or substantially more than six ridges and that the distance between multiple ridges can vary to regulate the expansion and compression effects described herein. In some embodiments, the exterior angles of the convex corners measure between 204° and 210° (inclusive), and the exterior angles of the concave corners measure between 120° and 160° (inclusive). As illustrated, the exterior angle of the concave corners is 150°. Further, the compression surfaces 86 are sloped between 30° and 36° (inclusive) relative to the baffle axis BA and the expansion surfaces 88 are likewise sloped between 0° and 6° (inclusive relative to the baffle axis. For example, as shown the compression surface 86 makes an angle of about 30° with the baffle axis in a proximal portion of the proximal exterior surface 80, and another compression surface in a more distal portion of the proximal exterior surface makes an angle of about 36° with the baffle axis. It is contemplated that in other embodiments, the slopes and relative angles of the compression surfaces and the expansion surfaces can differ from the illustrated embodiment without departing from the scope of the invention described herein. Moreover, the exterior angles of the concave corners and the exterior angles of the convex corners do not have to be the same. As illustrated, the convex corners are about 204° from a distal end to a location. Further, while the ridges 84 of the present embodiment are shown to comprise straight, annular compression surfaces 86 and expansion surfaces 88, it will be understood that in other embodiments, the ridges may be configured to define different surface geometries that would similarly cause the exhaust gas to expand and contract according to the principles described herein.

Turning now to the other baffles of the baffle assembly 22, as are generally shown in FIGS. 2-4, it will be appreciated that the only substantial difference between the blast baffle 24 and the standard baffles 26 is that the blast baffle includes a threaded interface 78 on its distal baffle wall 72 while standard baffles do not. The differences between the blast baffle 24 and the end baffle 28 are more substantial. While the end baffle 28 also includes a proximal end wall 70 substantially identical to the proximal baffle wall 70 of the blast baffle 24, the end baffle does not have a straight distal baffle wall adjacent the proximal baffle wall. Instead, the end baffle 28 has a formed distal wall 90 which is configured to receive the end cap assembly 16 and to direct the exhaust gas through end cap assembly 16 toward the outside environment, as will be discussed in greater detail below.

Referring again to FIGS. 8-9 and the associated expansion and compression effects of the proximal exterior surface 80 of the blast baffle 24, it will be appreciated that substantially the same effects occur with respect to the standard baffles 26 and the end baffle 28, as these baffles include the same ridged surfaces. Of course, it will be appreciated that in other embodiments, one or more baffles could have a differently configured surface that could result in less or more energy dissipation relative to the blast baffle 24.

Referring to FIGS. 10-18, the end cap assembly 16 is secured to sleeve 12 and end baffle 28 at the distal end of suppressor 10 and includes multiple exits for the exhaust gas to travel through to exit to the environment on the exterior of the suppressor. The exit paths out of end cap assembly 16 are configured to further dissipate energy and reduce the volume of the firearm's report. As discussed in greater detail below, the exit paths out of end cap assemblies in other embodiments may be configured for additional advantages, such as suppressing the flash produced by exhaust gas leaving the suppressor. The end cap assembly 16 includes an end cap holder 18 and an end cap 20, which are configured to be threadably attached to one another about central axis CA. First, end cap 20 includes a central exit defined by central bore 92. In the illustrated embodiment, the central exit is centered on an axis coincident with central axis CA and forms part of projectile passage 30.

Figure 18:
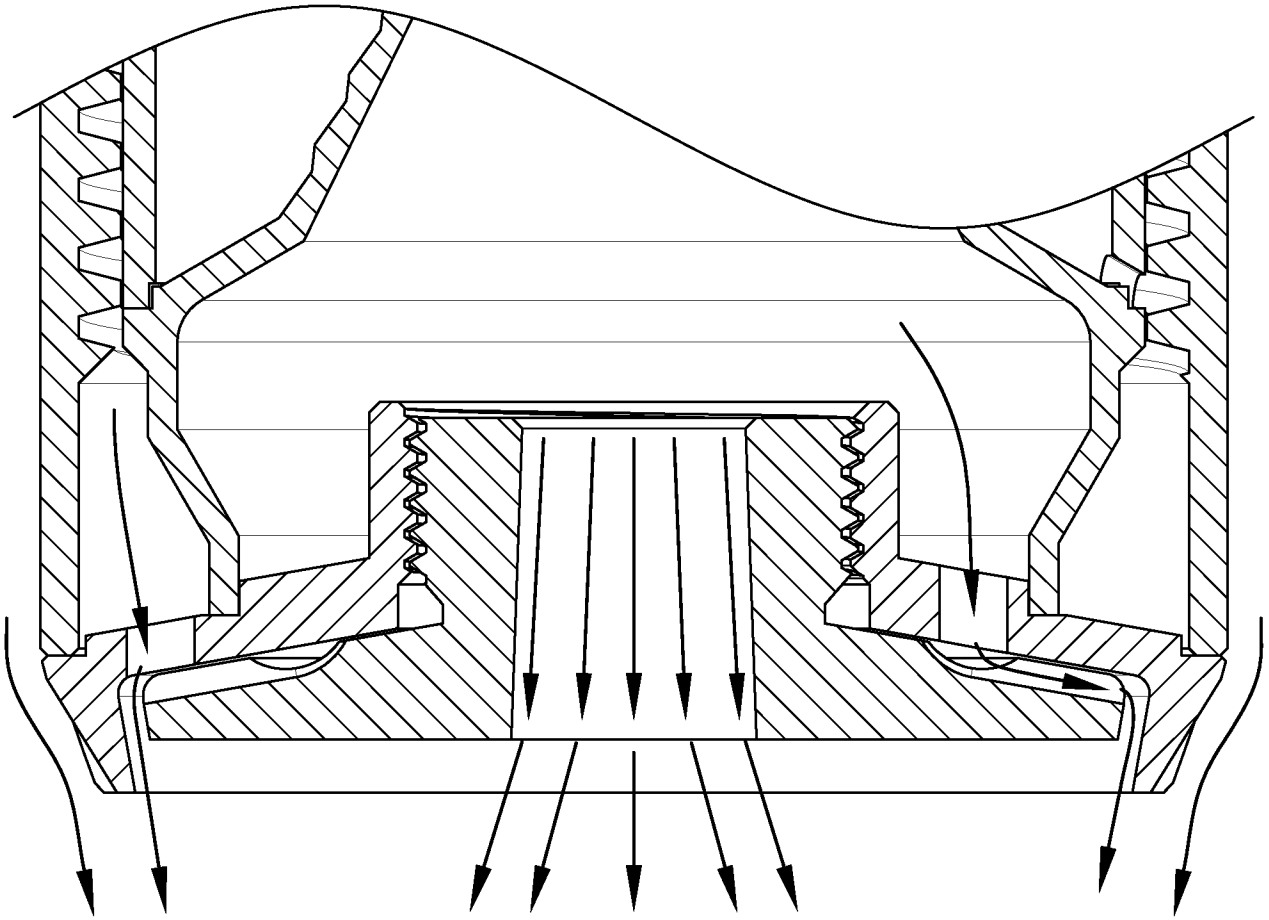
FIG. 18 is the view of FIG. 17, further including flow indication arrows.

As shown by the arrows in the center of FIG. 18, the central bore 92 is dimensioned and configured to direct exhaust gas outward from suppressor 10 in an expanding conical pattern. In the illustrated embodiment, the central bore 92 increases in diameter slightly near front face 94 of end cap 20. It will be appreciated that this expanding profile causes a drop in pressure and a resulting reduction in energy. Further, the expanding path of the exhaust gas from central bore 92 will intersect with a contracting path of exhaust gas from circumferential port 114, which will cause turbulence and additional energy dissipation.

Figure 10:
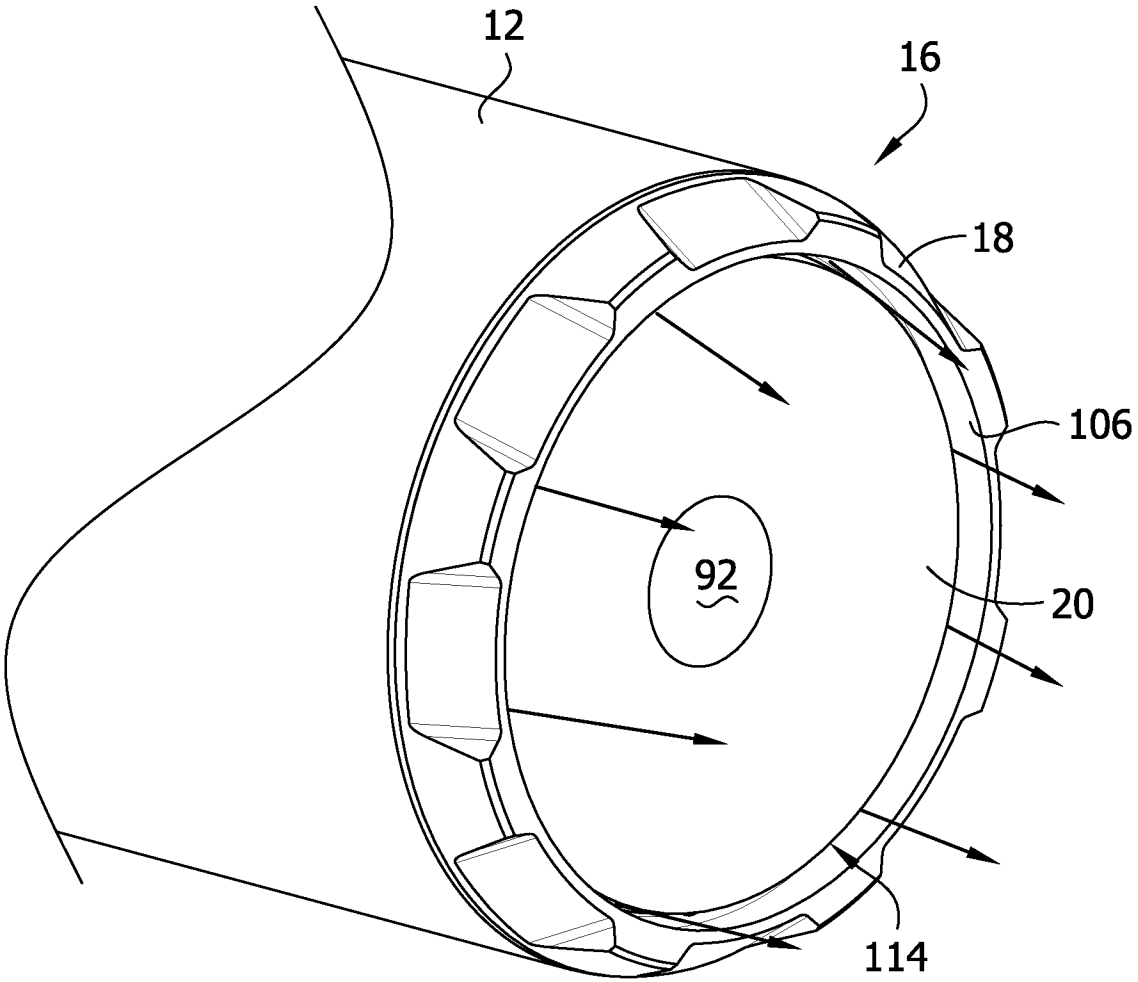
FIG. 10 is a fragmentary perspective of outlet end of the suppressor of FIG. 1.
Figure 11:
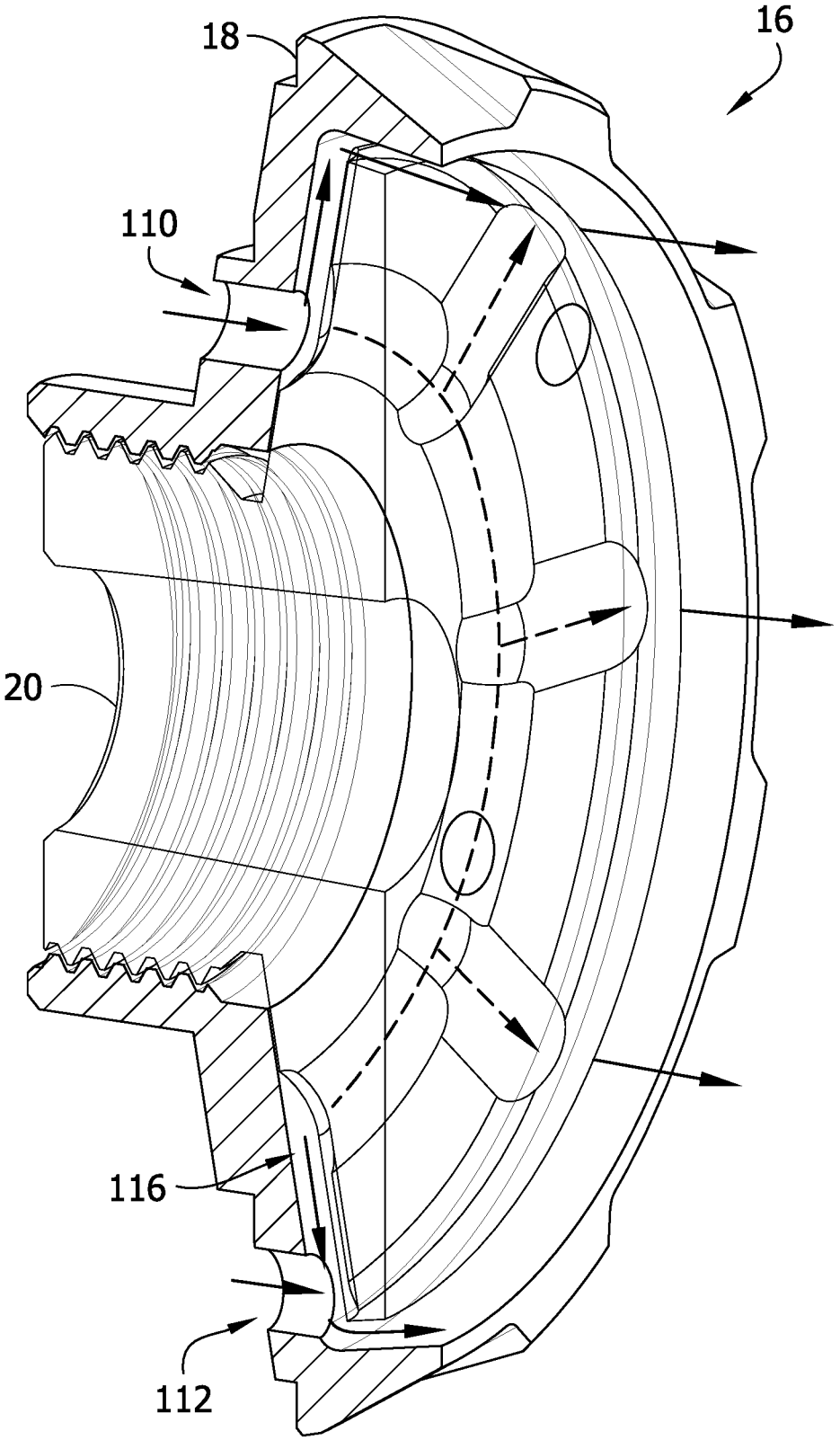
FIG. 11 is a perspective in section of an end cap assembly of the suppressor of FIG. 1, wherein an end cap of the end cap assembly is transparent.
Figure 12:
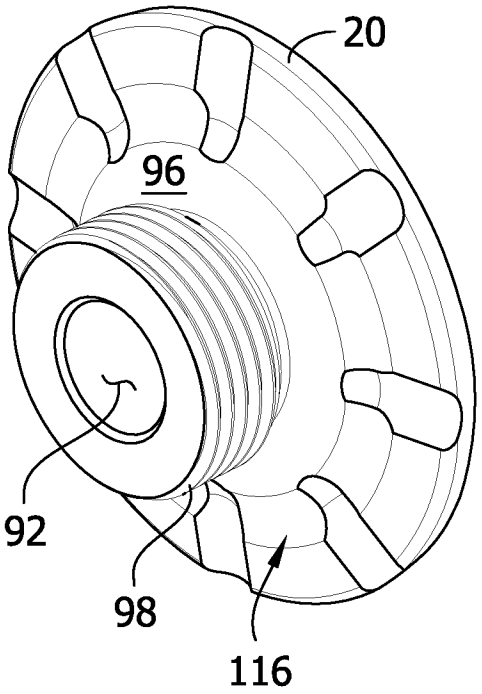
FIG. 12 is a perspective of the end cap assembly, with the end cap exploded from an end cap holder of the end cap assembly.
Figure 12:
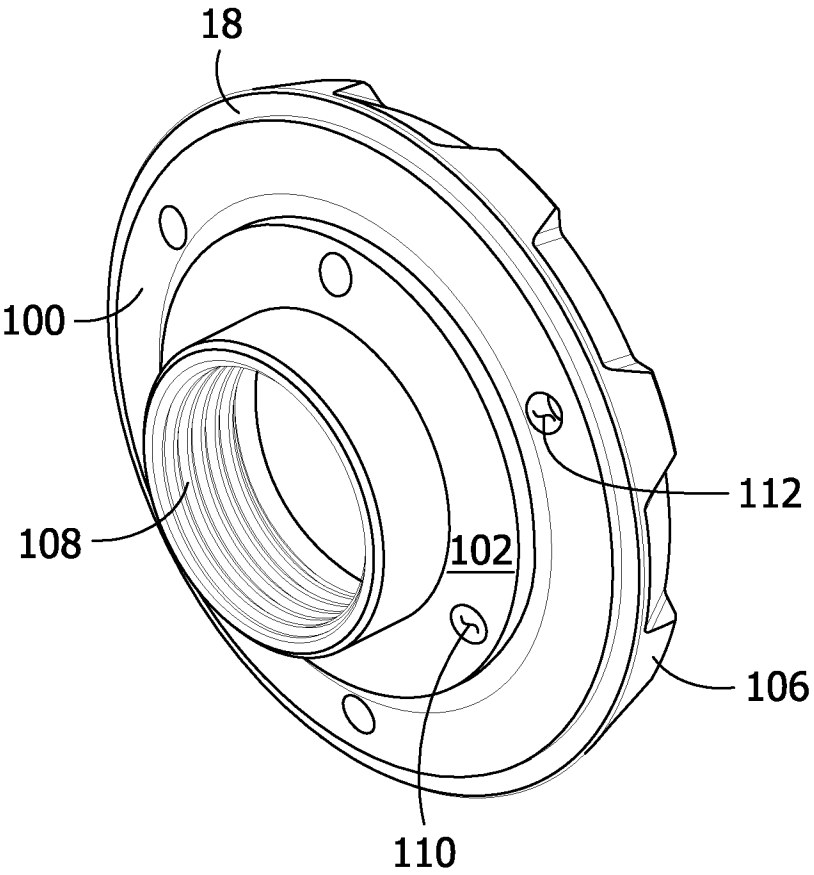
Figure 13:
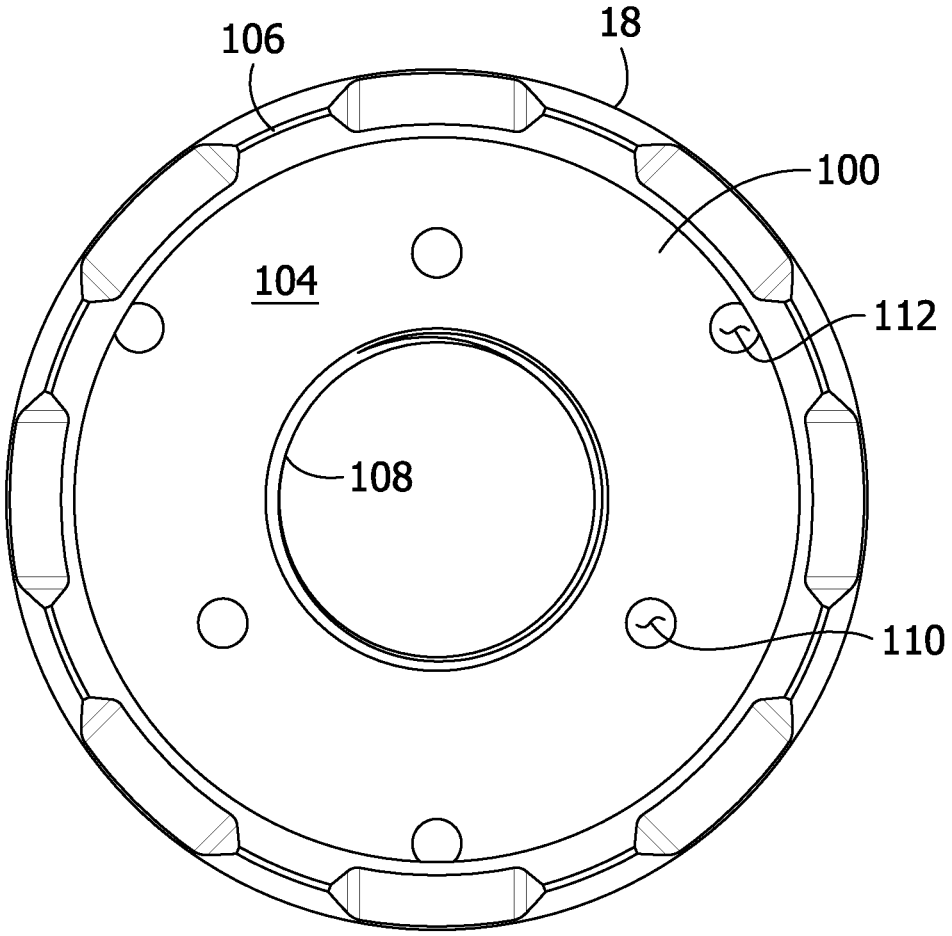
FIG. 13 is a front elevation of the end cap holder.
Figure 14:
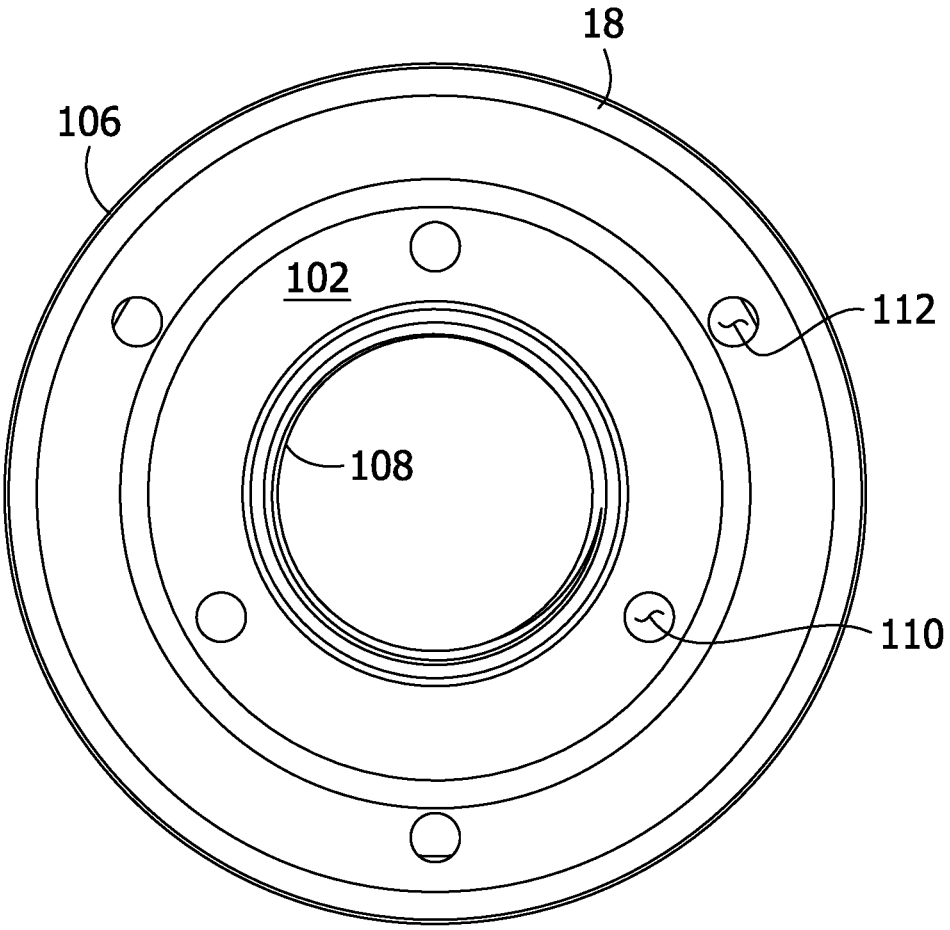
FIG. 14 is a rear elevation of the end cap holder.
Figure 15:
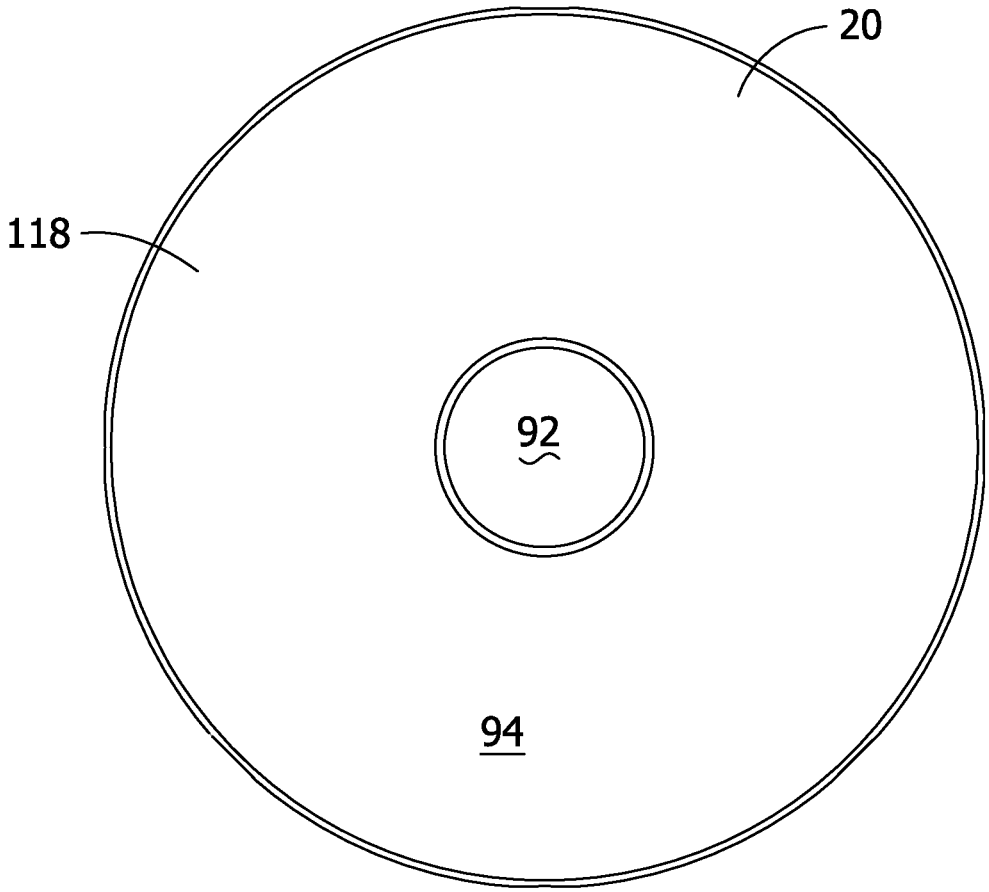
FIG. 15 is a front elevation of the end cap.
Figure 16:
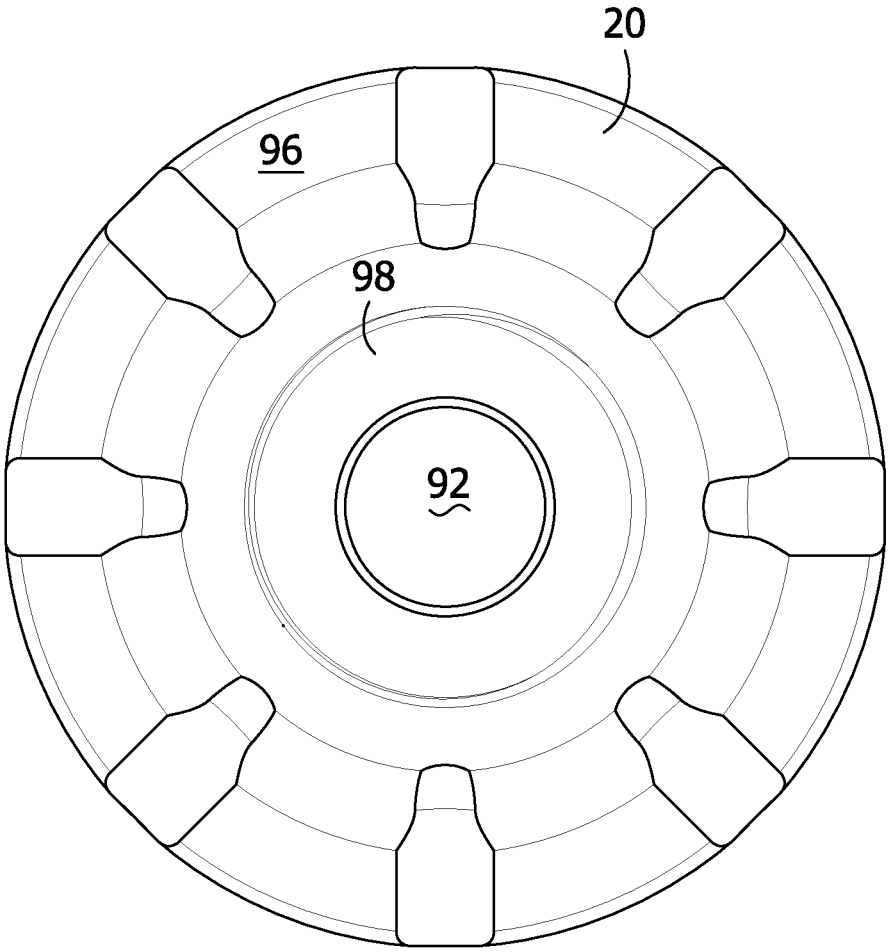
FIG. 16 is a rear elevation thereof.

In addition to the central exit through central bore 92, end cap assembly 16 includes a second exit path which leads exhaust gas out through circumferential port 114 near outer rim 106, as is generally shown by the arrows in FIGS. 10-11 and 18. The second exit path is defined by a plurality of intermediate ports 110 and peripheral ports 112 in end cap holder 18, manifold 116, and circumferential port 114. The intermediate ports 110 are part of a second exhaust gas passage. The peripheral ports 112 are part of a third exhaust gas passage. The second and third exhaust gas passages converge within the end cap assembly 16. The circumferential port extends continuously around the periphery of the end cap 20 between the end cap and the end cap holder 18. As a result, a cone of exhaust gas is emitted from the circumferential port 114 directed toward the projectile axis. It will be appreciated that manifold 116 and circumferential port 114 are defined by the space between the outer face 104 of end cap holder 18 and the rear face 96 of end cap 20, as will be described in greater detail herein.

As shown in FIGS. 11-16, the end cap holder 18 has a saucer-shaped body 100 with a ridged inner face 102, a flattened outer face 104, and the outer rim 106 protruding from outer face 104. Additionally, the end cap holder 18 includes a threaded receiving portion 108 which protrudes from the inner face 102 and is configured to tightly receive a corresponding threaded fitting portion 98 protruding from end cap 20. The outer face 104 is generally configured to conform closely with rear face 96 of end cap 20, though it will be appreciated that the rear face 96 of end cap 20 includes an annular recess defining a manifold 116 between the rear face 96 and the outer face 104. Spoked recesses in the back side of the end cap 20 extend out from the manifold 116 to the circumferential periphery of the end cap. The annular recess and the spoked recesses provide space for exhaust gas to pass between outer face 104 of end cap holder 18 and rear face 96 of end cap 20. Similarly, outer rim 106 of the end cap holder 18 (broadly, "an annular wall") is configured to surround the outermost surface of end cap 20 while still leaving a small space between the outer rim and a peripheral edge 107 of the end cap which defines circumferential port 114.

Figure 17:
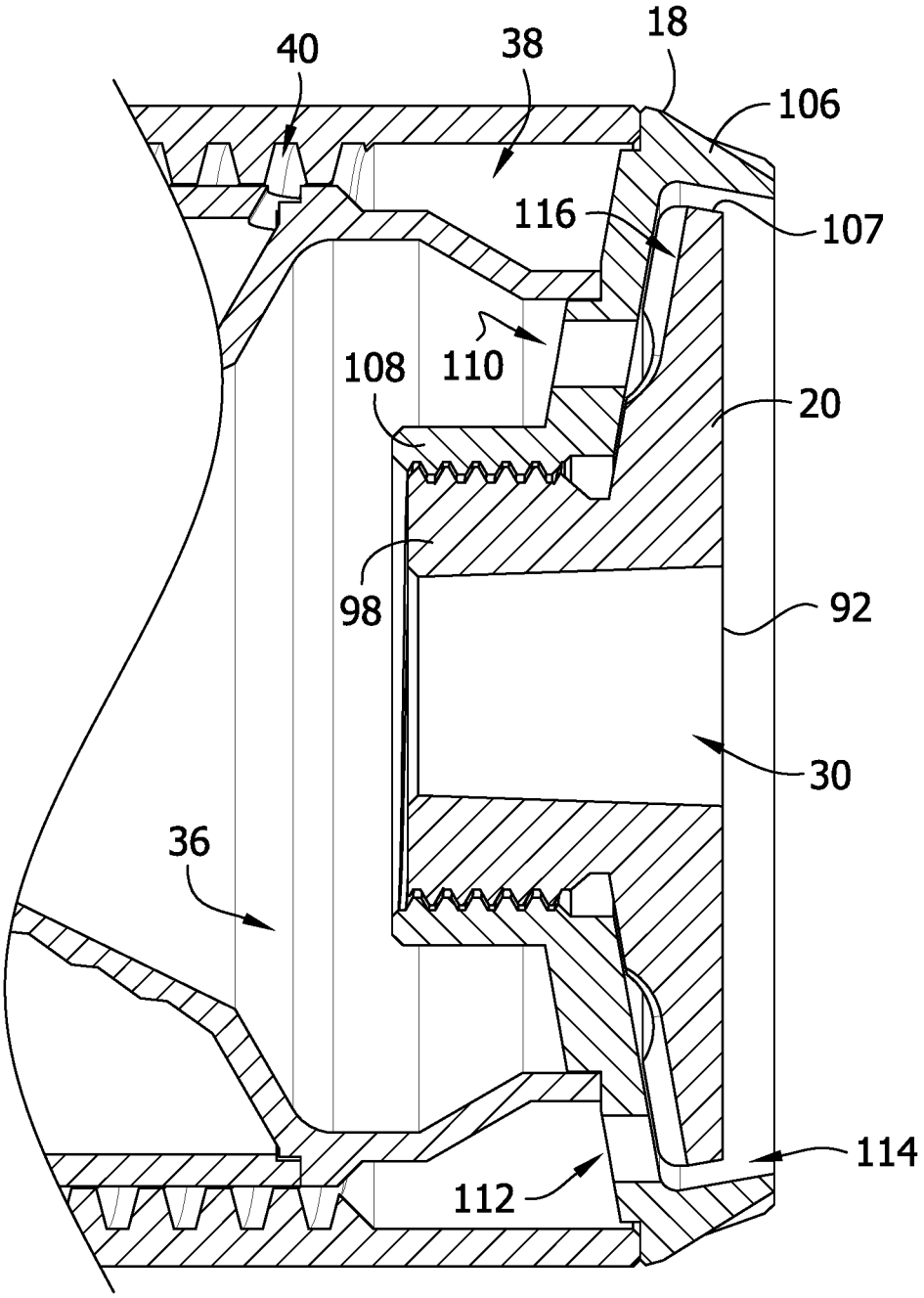
FIG. 17 is an enlarged, fragment of the section of FIG. 4.

Additionally, end cap holder 18 includes numerous intermediate ports 110 and peripheral ports 112 which traverse body 100 from inner face 102 to outer face 104. These ports are configured to communicate with manifold 116 and circumferential port 114 to define the second exit path, as is seen in FIGS. 11 and 18. Specifically, intermediate ports 110 are spaced radially apart about halfway between central bore 92 and outer rim 106, and they allow communication between end chamber 36 and manifold 116. Likewise, peripheral ports 112 are spaced radially apart near the perimeter of end cap holder 18, and they allow direct communication between forward chamber 38 and circumferential port 114. Referring now to FIG. 17, the intermediate ports of the end cap holder provide fluid communication from within the end baffle to the manifold and hence to the circumferential port of the end cap assembly. The peripheral ports communicate with a forward chamber defined between the distal portion of the end baffle, the sleeve and the end cap holder. Exhaust gas traveling through the helical grooves exits into the forward chamber. The peripheral port exhausts gas from the forward chamber directly to the circumferential port.

As is shown in FIGS. 10-11 and 17-18, the interior wall of outer rim 106 and the peripheral edge 107 of end cap 20 have a similar slope relative to central axis CA of suppressor 10, and this slope defines a general direction for exhaust gas leaving circumferential port 114. As shown, circumferential port 114 directs the exhaust gas slightly inward in cone toward central axis CA. As illustrated by the arrows in FIG. 18, the inward trajectory of the gas introduces turbulence in two ways. First, as explained herein above, the expanding path of the exhaust gas from central bore 92 will intersect with the contracting path of exhaust gas from circumferential port 114. Second, boundary layer viscosity and dynamic pressure will cause some of the ambient air surrounding suppressor 10 to travel and mix with the gas exiting circumferential port 114. This second effect is enhanced by the inward-sloping surfaces of outer rim 106, which provide a path of least resistance for the ambient air. In both cases, the turbulence will result in energy dissipation. In the illustrated embodiment, the circumferential port 114 is configured to direct exhaust gas inward at an angle in an inclusive range from 8° to 12° relative to the central axis CA, and central bore 92 is similarly configured to direct exhaust gas outward at a nominal angle ranging from between 2° and 10° relative to the central axis CA. In other embodiments, it is contemplated that the end cap assembly can be configured to direct exhaust gas at different relative angles to introduce different patterns of turbulence without departing from the scope of the invention.

Further modifications can be made to the end cap assembly to generate additional turbulence, not only for noise reduction but also for reducing the intensity of the flash from the muzzle of the firearm. As shown in FIGS. 24-28, in an alternative embodiment, end cap 220 includes the same general features as end cap 20 but further includes a more pronounced conical profile at the outlet end of central bore 292, a flow interruption channel 250 at the proximal end of the central bore, and an additional set of angled bores 260 branching out from the central bore and corresponding ridges 270, 272 protruding from front face 294 and recesses 280, 282 between ridges 270, 272. In the present embodiment, the conical profile of the central bore 292 is configured to direct exhaust gas outward from the suppressor at an angle of between 8° and 10° relative to the central axis CA. It will be appreciated that in other embodiments, the central bore may be configured to direct exhaust gas outward at a greater or lesser angle depending on the caliber of the firearm to be used with the suppressor (e.g., between 8° and 10°).

Figure 24:
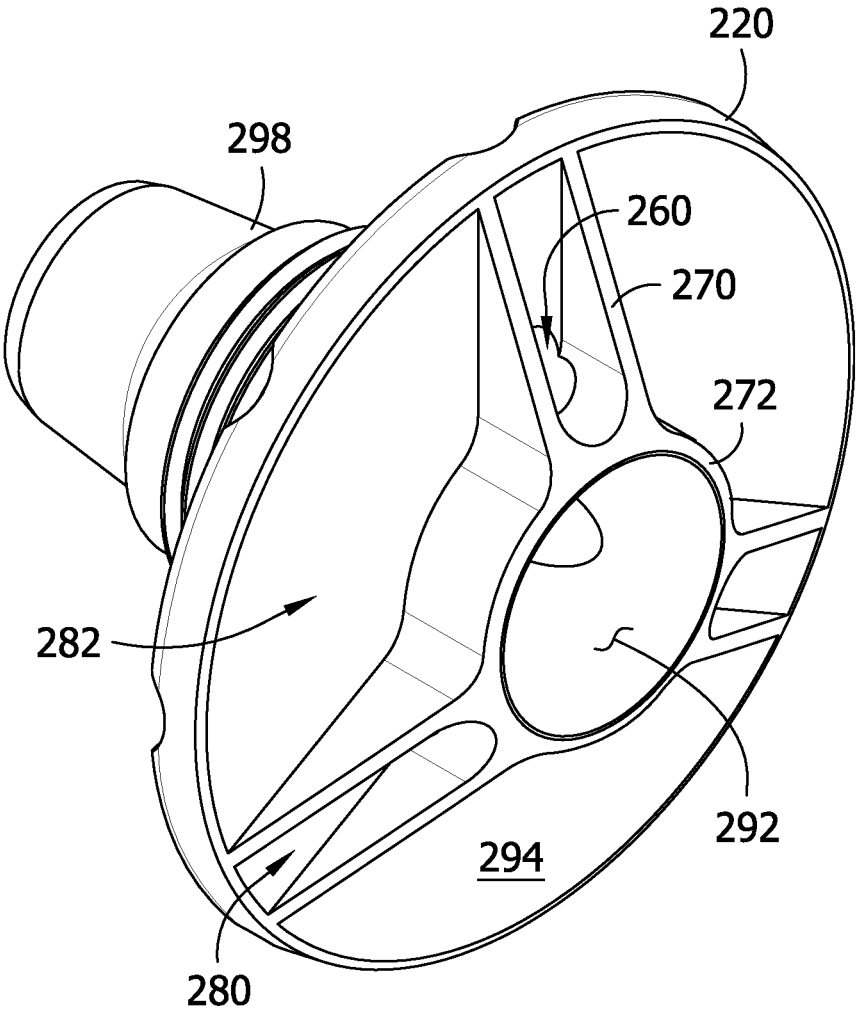
FIG. 24 is a front perspective of a second embodiment of an end cap for the suppressor of FIG. 1.
Figure 25:
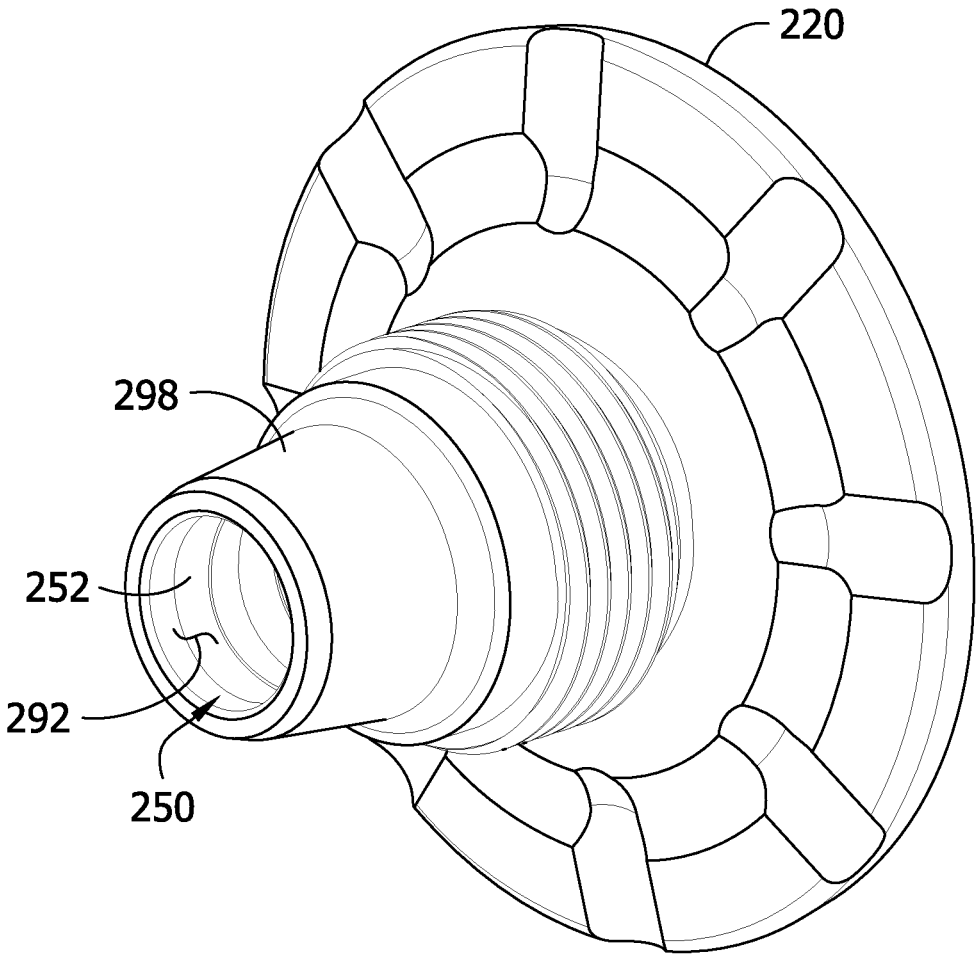
FIG. 25 is a rear perspective thereof.
Figure 28:
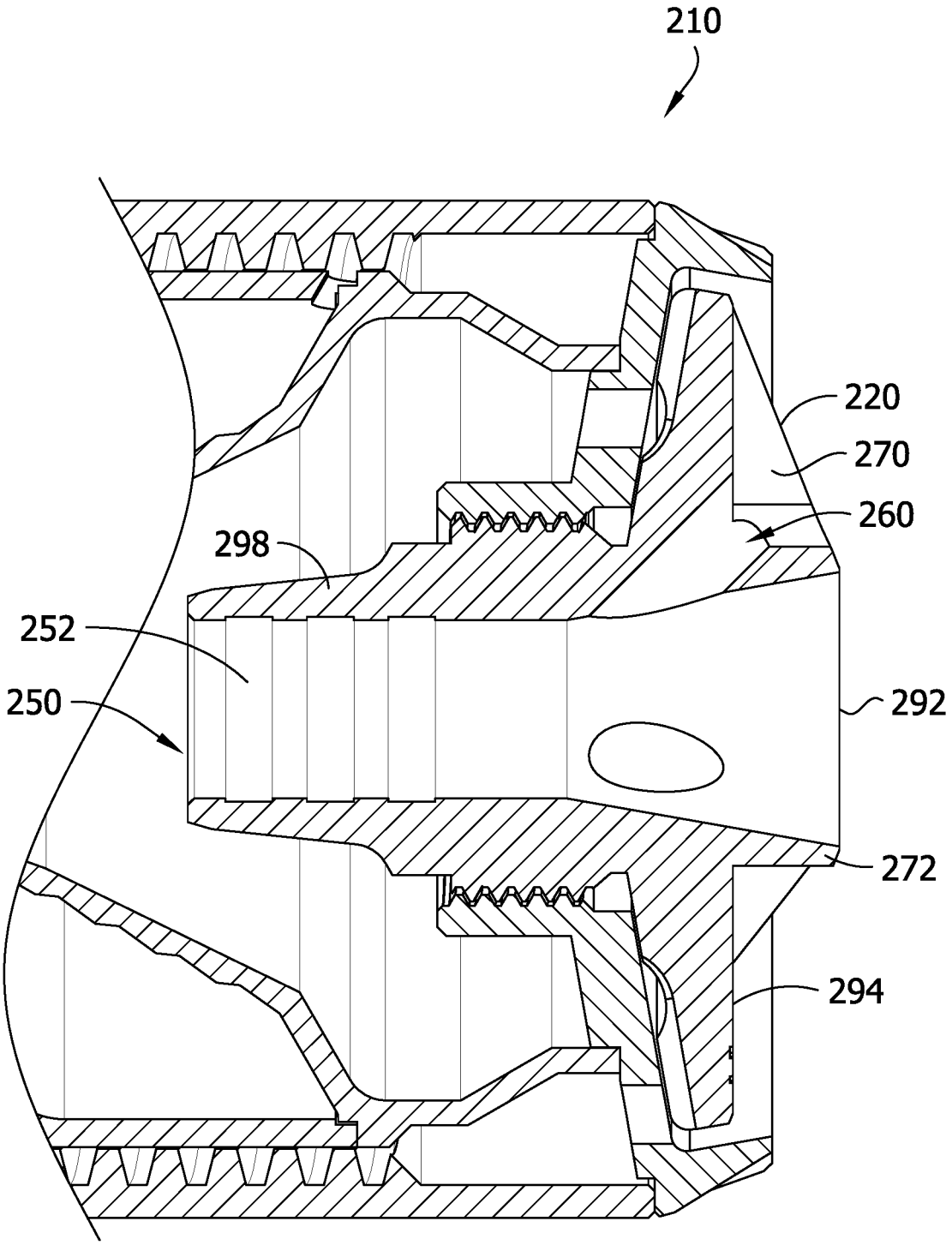
FIG. 28 is an enlarged, fragmentary longitudinal section of a portion of the suppressor of FIG. 1 with the end cap of FIG. 24.

As shown in FIGS. 24-25 and 28, the end cap 220 includes an elongated fitting portion 298 which provides space for flow interruption channel 250 at the proximal end of central bore 292. Further, a tapered (conical) exterior proximal end of the fitting portion 298 directs some of the exhaust gas outward in a manner similar to the conical proximal baffle walls 70 described above. The diverted exhaust gas may exit the interior of the suppressor through intermediate ports 346 described more fully hereinafter. Referring to FIG. 28, the flow interruption channel 250 has three spaced-apart annular recesses 252 which introduce pockets of turbulence in the flow of gas through the proximal end of central bore 292. In other embodiments, other shapes, textures, or patterns may be used in addition to or instead of annular recesses 252 to generate energy-dissipating turbulence.

Figure 26:
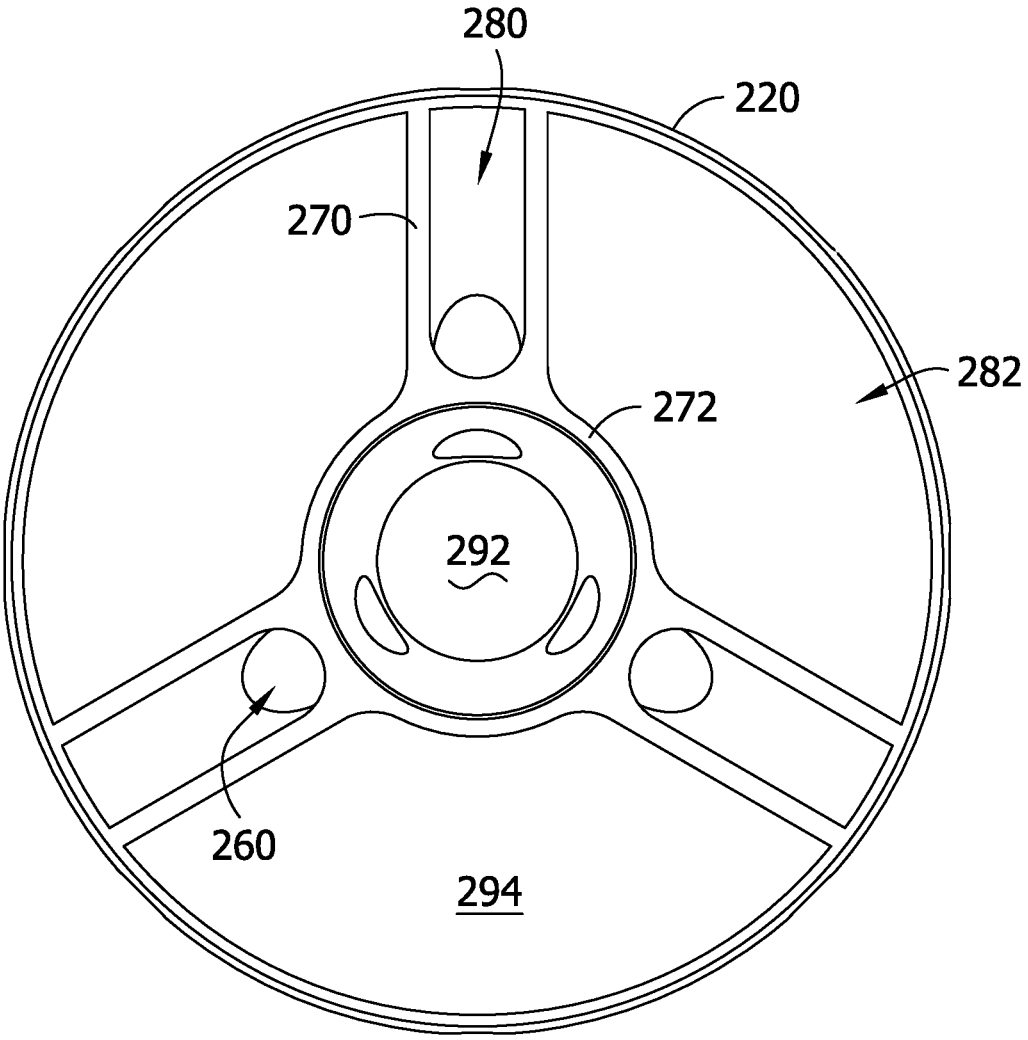
FIG. 26 is a front elevation thereof.
Figure 27:
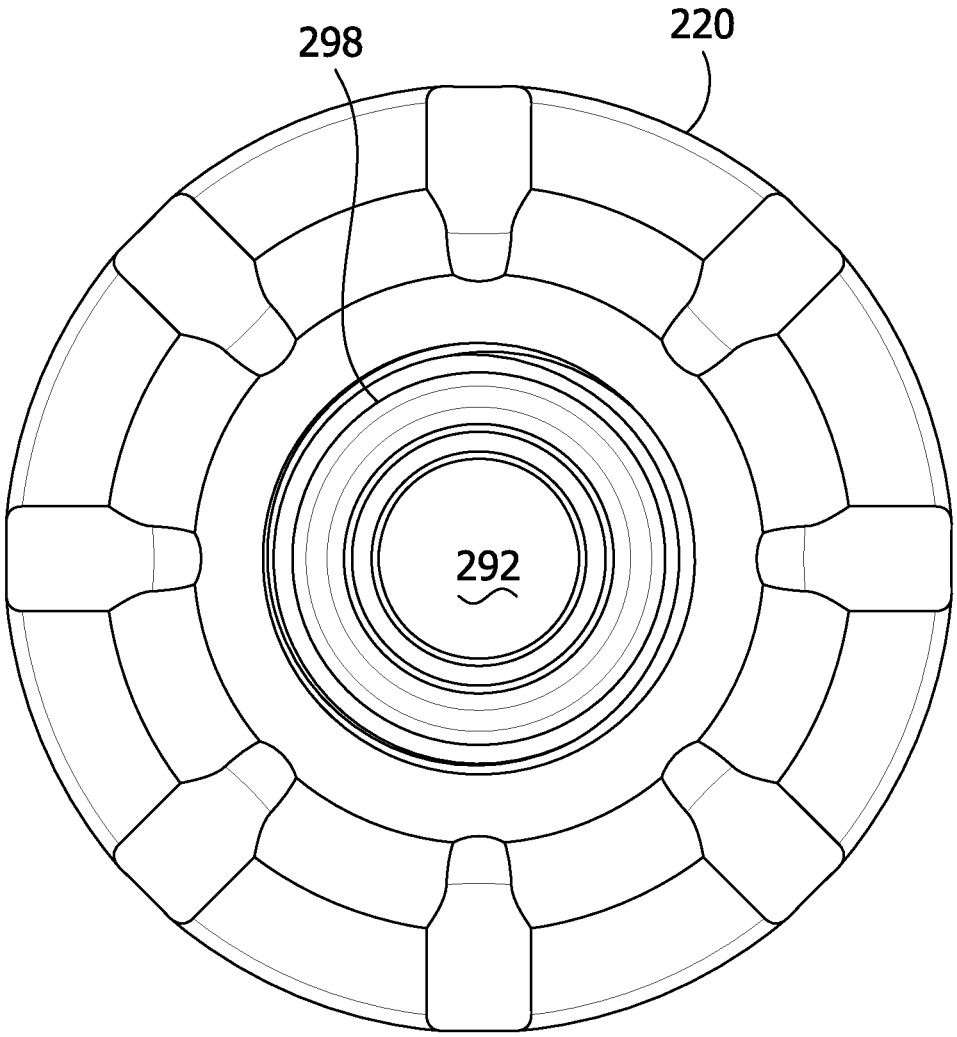
FIG. 27 is a rear elevation thereof.

Referring now to FIGS. 24-26 and 28, angled bores 260, radial ridges 270, and central, annular ridge 272 define an additional set of exit passages for the exhaust gas. Radial ridges 270 and central ridge 272 further define narrow radial recesses 280 and broad recesses 282. Angled bores 260 project outward toward front face 294 at approximately 45° relative to the central axis of end cap 220, opening at a first end into central bore 292 near the bore's longitudinal center. The angled bores 260 each open at a second end through front face 294 and ridges 270, 272 at a location radially outward from central bore 292 and within a respective one of the narrow radial recesses 280. As shown in FIG. 26, end cap 220 has three angled bores 260 which are disposed radially at equal distances around the central axis of the end cap. It is contemplated that the placement, quantity, and/or angle of angled bores 260 can vary while still providing the advantages stated herein.

The angled bores 260, central bore 292, radial ridges 270 and central ridge 272 are configured to interact with the exhaust gas leaving the end cap 220 through the various exit paths to facilitate the mixing of exhaust gas and cooler air from the outside environment so as to suppress the flash. The radial recesses 280 and the broad recesses 282 create pockets of turbulence near the front face 294 on the exterior of the suppressor 210, which can draw cooler ambient air into the exhaust flow. The heights of the radial ridges 270 taper from their intersections with the central ridge 272 to the perimeter of the end cap 220. Testing has shown that better flash suppression is achieved using the tapered radial ridges 270 as compared to having the angled bores 260 and central bore 292 exit to the same surface (i.e., with no recesses around the bore exits), or where the radial ridges have a constant height to the perimeter of the end cap 220.

In use, the suppressor 10 can be removably attached to and used with a firearm (not shown) to reduce recoil, pressure, heat, and report volume when a bullet and exhaust gas are discharged from the firearm. Referring to FIG. 4, the elements of the suppressor 10 define a plurality of flow passages extending from the suppressor's proximal end to its distal end. As the exhaust gas is directed along the various flow passages and outward through the end cap assembly 16, pressure in the exhaust gas is reduced, turbulence is generated, energy is dissipated, and the time it takes for the exhaust gas to depart suppressor 10 is extended.

As is shown in FIG. 4, the baffle assembly 22 is configured to channel a substantial amount of the gas away from the projectile passage 30, through one of the peripheral channels 40 disposed on the inner wall of sleeve 12, and through the forward chamber 38, before exiting the suppressor 10 through the end cap assembly 16. The blast baffle 24 directs the exhaust gas in entrance chamber 32 toward the respective entrances of peripheral channels 40. Similarly, each of the subsequent baffles (standard baffles 26, end baffle 28) directs the gas within a respective baffle chamber 34 toward the peripheral channels 40 via baffle ports 60. As is described below in connection with FIGS. 11-16, central bore 92, intermediate ports 110, and peripheral ports 112 in end cap assembly 16 further define the various exit paths out of end chamber 36. Each baffle port is positioned for directing exhaust gas into a particular one of the three distinct peripheral channels 40.

As shown in FIG. 2, projectile passage 30 is the unobstructed region extending along central axis CA and through the center of baffle assembly 22 and end cap assembly 16 to the distal end of the suppressor 10. It is thus understood that projectile passage 30 is partially defined by the central openings in the baffles 24, 26, 28 of baffle assembly 22 and the central bore 92 in end cap 20. While projectile passage 30 is necessarily dimensioned so the fired bullet can travel across suppressor 10 from its proximal end to its distal end when the firearm is fired, it will be appreciated that some of the exhaust gas will also travel directly through projectile passage 30. However, a substantial amount of the exhaust gas will also be directed away from projectile passage 30 and along alternative paths that also lead to the environment on the exterior of suppressor 10. The additional flow paths also have energy-dissipating functions, as discussed above. Further, the substantial difference in length of the various flow passages causes the exhaust gas to exit the suppressor over a prolonged period of time, reducing the recoil effect experienced by the firearm-suppressor assembly.

It will be appreciated that, due to the helical path of the peripheral channels 40, the travel distance of the exhaust gas channeled through the peripheral passages is substantially longer than the travel distance through projectile passage 30. As a consequence, this gas takes longer to travel through and leave suppressor 10. Further, the helical shape of the peripheral channels 40 introduces substantial turbulence and causes the gas to continuously change direction, resulting in significant energy dissipation and drops in pressure.

For improved energy dissipation as gas travels across the proximal exterior surface 80 and the proximal interior surface 82 of a baffle, the proximal baffle wall 70 is further configured to include several discrete portions that increase in steepness progressively. Referring to FIG. 9, the wall of proximal baffle wall 70 is generally sloped at an angle of approximately 20° relative to blast baffle axis BA near its proximal end, increases to approximately 26° in a middle portion adjacent the proximal end, and then increases to approximately 60° in a distal portion between the middle portion and distal baffle wall 72. Along the proximal exterior surface 80, these inflections effectively generate compression and turbulence, generally consistent with the above description of the annular compression surfaces 86 and corresponding valleys between the ridges 84. Along the proximal interior surface 82, these inflections result in expansion and a drop in pressure, generally consistent with the above description of the annular expansion surfaces 88 and corresponding peaks of the ridges 84. It is understood that in other embodiments, the number of progressive sections, the respective angle of each section, and the change in slope from section to section can vary.

Figure 19:
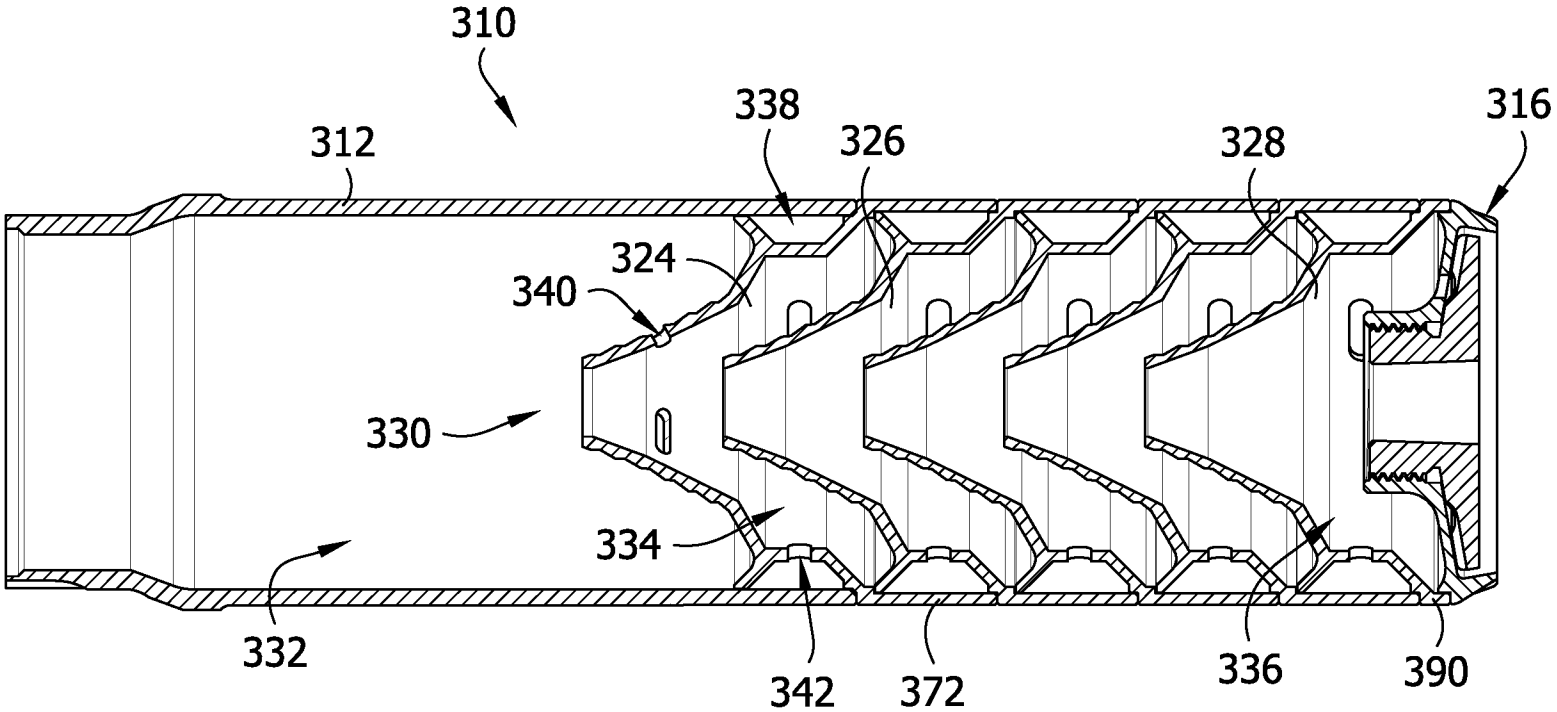
FIG. 19 is a longitudinal section of a second embodiment of a suppressor.
Figure 20:
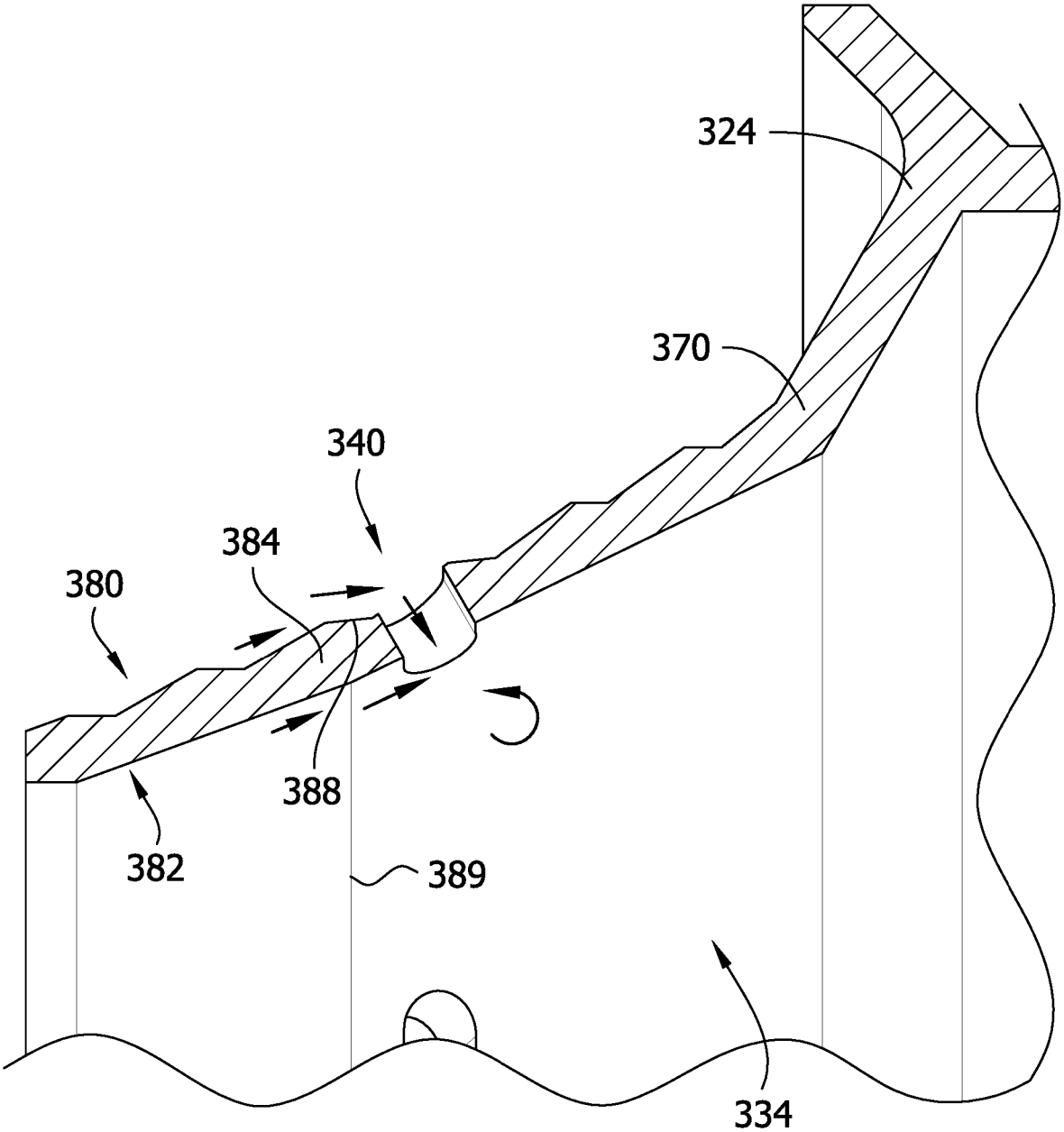
FIG. 20 is a longitudinal section of a portion of the blast baffle of the suppressor of FIG. 19, including flow indication arrows.
Figure 21:
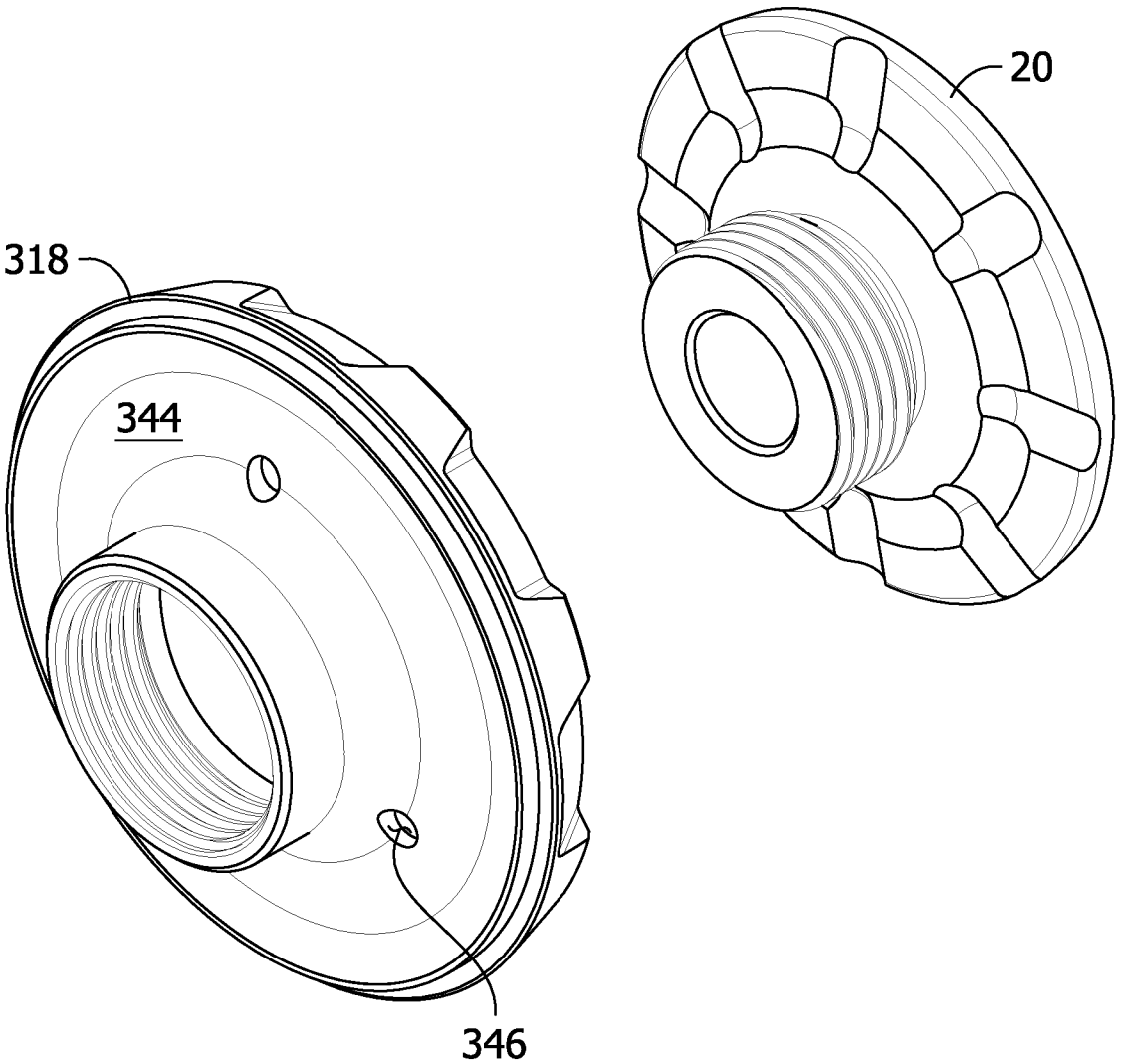
FIG. 21 is a perspective of the end cap assembly of the suppressor of FIG. 19, with the end cap exploded from an end cap holder of the end cap assembly.
Figure 22:
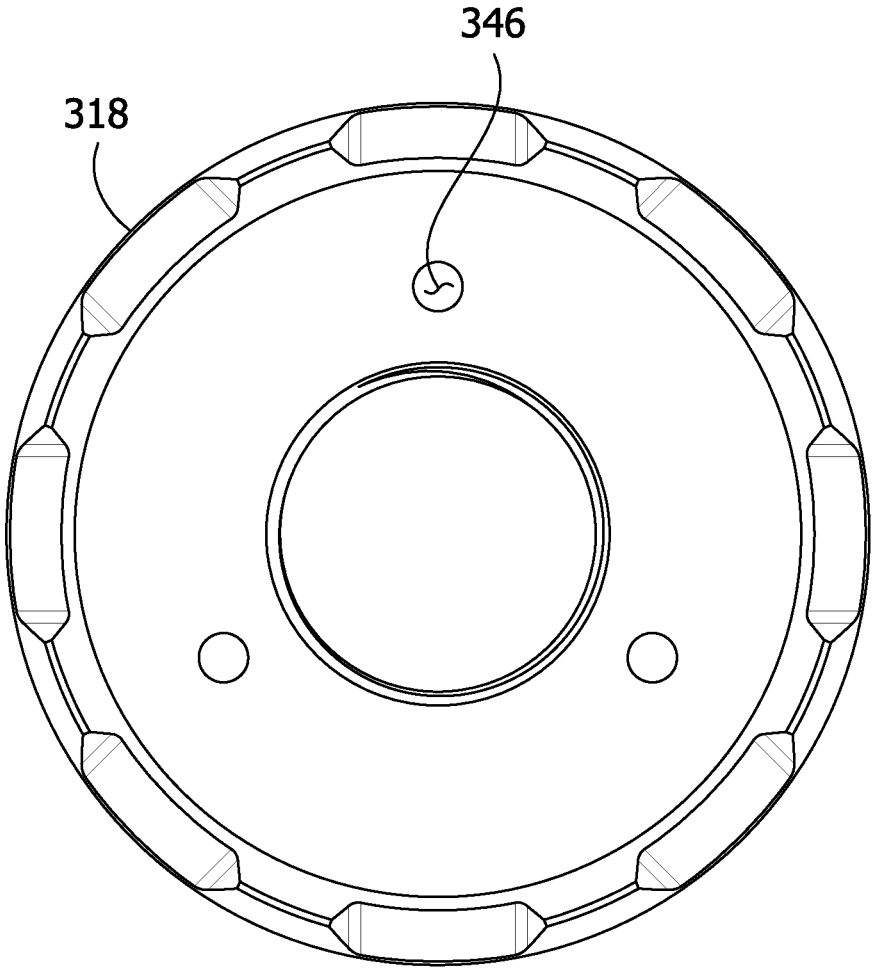
FIG. 22 is a front elevation of the end cap holder of FIG. 21.
Figure 23:
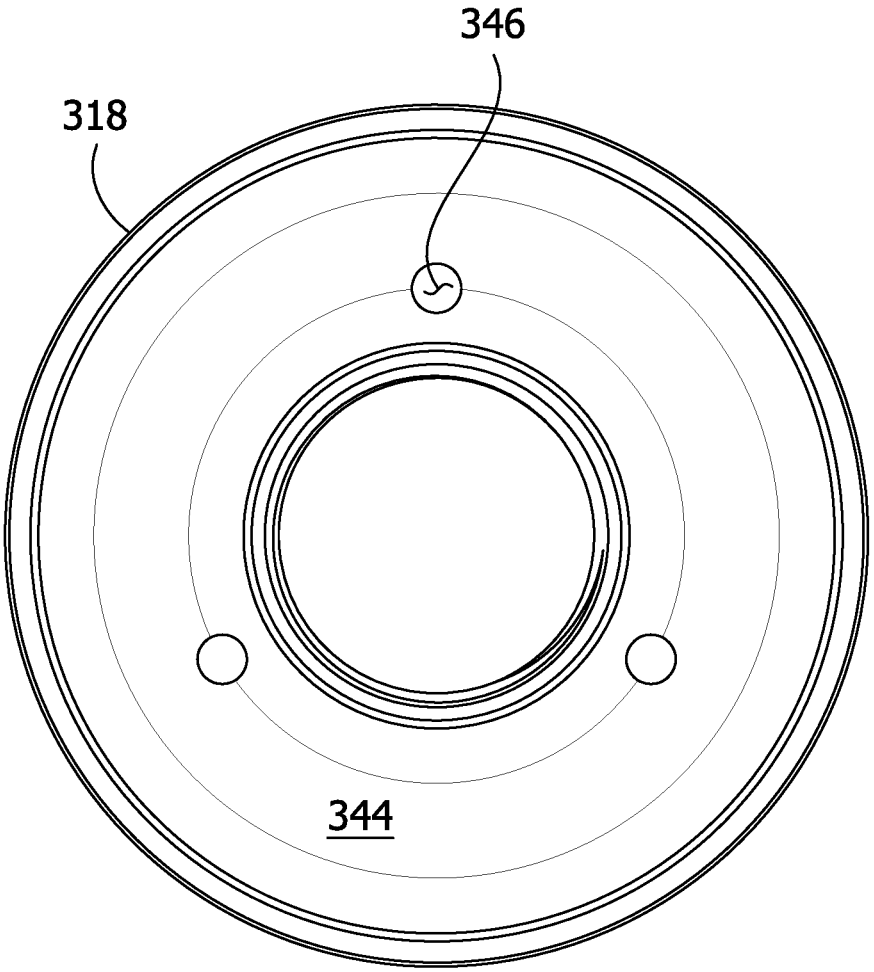
FIG. 23 is a rear elevation of the end cap holder thereof.

In further embodiments, the baffles may include additional energy-dissipating elements. Referring now to FIGS. 19-20, the blast baffle 324 of suppressor 310 includes three angled ports 340 located in the proximal baffle wall 370. The angled ports 340 are configured to direct exhaust gas through the proximal baffle wall 370 and into an adjacent interior conical volume to generate turbulence (and energy dissipation) within the adjacent baffle chamber 334. In the depicted embodiment, angled ports are elongate in a direction generally circumferential of the conical portions of the baffles. The angled ports 340 are spaced apart from one another along the circumference of proximal baffle wall 370.

As shown in FIG. 20, the angled ports 340 are located downstream of an annular expansion surface 388 following a ridge 384 in the proximal exterior surface 380. Additionally, the angled ports 340 are located downstream of a circumferentially extending inflection line 389 between a proximal conical region and a distal conical region in the proximal baffle wall 370 which defines a corresponding expansion corner in the proximal interior surface 382. In accordance with the fluid principles described above (e.g., the Prandtl-Meyer formulas), the flow of exhaust gas along both the proximal exterior surface 380 and the proximal interior surface 382 urges the gas to travel through the angled ports 340 and into the adjacent baffle chamber 334. With respect to the exhaust gas that flows across the proximal exterior surface 380 (and as indicated by the corresponding arrows in FIG. 20), the gas will expand over the convex corner defined by the ridge 384, and then some of the gas will deflect again over the convex corners at the respective entrances to the angled ports 340. Thus, some exhaust gas is directed through the angled ports 340 and into the baffle chamber 334. With respect to the exhaust gas that flows across the proximal interior surface 382, the expansion corner located at the inflection point of the proximal baffle wall 370 causes the gas to form an expansion fan, which results in an increase in flow velocity downstream of the expansion corner (as indicated by the corresponding arrows in FIG. 20) and a corresponding drop in pressure. The relatively low dynamic pressure of the exhaust gas traveling across the proximal interior surface 382 perpendicular to the outlet end of the angled ports 340 aspirates some of the gas on the proximate exterior surface 380 through the angled ports 340 and into the adjacent baffle chamber 334. As indicated by the arrows in FIG. 20, the intersection of gas traveling through the angled ports 340 and gas flowing generally perpendicularly along the proximal interior surface 382 results in energy-dissipating turbulence in the baffle chamber 334.

While the embodiment shown in FIG. 19 includes angled ports 340 in blast baffle 324 only, it is contemplated that in other embodiments, additional angled ports could be located in the subsequent standard baffles 326 and/or the end baffle 328 to introduce further energy-dissipating turbulence within subsequent baffle chambers 334 or the end chamber 336. The number of angled ports can be greater or fewer than three without departing from the scope of the present invention. It is further contemplated that angled ports of a similar configuration could be incorporated into other embodiments—including the embodiment shown in FIGS. 1-18—to yield generally the same results.

It will be understood that alternative embodiments of the invention can include other features to dissipate energy and reduce the volume of the report of the firearm. As generally shown in FIG. 19, the suppressor 310 includes a sleeve 312, a blast baffle 324, a plurality of standard baffles 326, and an end baffle 328, which are configured to receive one another in a linear arrangement to define the entrance chamber 332, the baffle chambers 334, the end chamber 336, as well as a plurality of annular chambers 338. It will be appreciated that the baffle chambers 334 and the annular chambers 338 do not lead to an outer flow path like the peripheral channels 40 shown in FIGS. 2 and 4 and described previously. Instead, the baffle chambers 334 and the annular chambers 338 are configured as remote chambers that absorb and dissipate the energy of the exhaust gas that is directed away from the projectile passage 330. It will be appreciated that the baffles 324, 326, 328 each include apertures 342 that allow for communication between a respective baffle chamber 334 (or end chamber 336, in the case of end baffle 328) and a corresponding annular chamber 338. Similar to the previous description in connection with FIGS. 10-11 and 17-18, the end cap assembly 316 is configured to be received by end baffle 328 and is further configured to direct some of the exhaust gas from end chamber 336 outward through a circumferential port in end cap assembly 316. As shown in FIGS. 24-26, the end cap holder 318 is configured differently from the end cap holder 18 used in suppressor 10 (shown generally in FIGS. 12-14). The inner face 344 is configured to engage only the end baffle 328 and therefore has a different ridged profile compared to the inner face 102 of end cap holder 18. Further, because the end cap assembly 316 interfaces entirely with end chamber 336 (and does not engage with a second chamber resembling forward chamber 38), the end cap holder 318 includes intermediate ports 346 but does not have ports resembling the peripheral ports 112 of suppressor 10. It will be understood, however, that the end cap holder 318 is configured to retain end caps of numerous shapes, including ones generally resembling the end cap 20 and/or the end cap 220 discussed above.

It will also be appreciated that the sleeve 312 shown in FIG. 19 does not span the entire length of suppressor 310 or receive the entirety of baffle assembly 322. Rather, the baffle assembly 322 is partially received by the sleeve 312 such that the proximal baffle wall 370 of blast baffle 324 occupies the internal volume of the sleeve 312 but the distal baffle wall 372 of the blast baffle protrudes forward relative to sleeve 312. The standard baffles 326 and the end baffle 328 are similarly received one by one, each respective distal baffle wall 372 or end baffle fitting 390 protruding forward to define a generally cylindrical exterior wall of the suppressor 310. In the illustrated embodiment, the sleeve 310 and the baffles 324, 326, 328 are welded, though it is understood they could be secured together in airtight engagement by another means in other embodiments.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

The invention claimed is:

1. A baffle for a firearm suppressor comprising a tubular body having a central axis, the tubular body being sized and shaped for receiving a bullet through the tubular body along the central axis from a proximal end of the tubular body to a distal end of the tubular body, the tubular body including a proximal exterior surface and a plurality of annular ridges on the proximal exterior surface, the annular ridges being spaced apart from each other in a direction along the central axis of the tubular body, a first of the ridges comprising a first annular compression surface having a proximal end and a distal end, the first annular compression surface angling away from the central axis at an angle skew to the central axis as the first annular compression surface extends from its proximal end to its distal end, the first annular compression surface being positioned for direct exposure proximally around its circumference to gas entering the firearm suppressor from a firearm when the baffle is mounted in the firearm suppressor and the firearm suppressor is attached to the firearm, and a first annular expansion surface extending from a proximal end to a distal end, the proximal end of the first annular expansion surface and distal end of the first annular compression surface at least partially defining a first expansion corner, an exterior angle between the first annular compression surface and the first annular expansion surface at the first expansion corner being greater than 180°, a second of the ridges comprising a second annular compression surface extending from a proximal end to a distal end, the proximal end of the second annular compression surface and the distal end of the first annular expansion surface at least partially defining a first compression corner, an exterior angle between the second annular compression surface and the first annular expansion surface at the first compression corner being less than 180° whereby gas flowing along the proximal exterior surface of the tubular body is expanded at the first expansion corner and compressed at the first compression corner to dissipate energy in the flowing gas.

2. The baffle as set forth in claim 1 wherein the second ridge further comprises a second annular expansion surface extending from a proximal end to a distal end, the proximal end of the second annular expansion surface and distal end of the second annular compression surface at least partially defining a second expansion corner, an exterior angle between the second annular compression surface and the second annular expansion surface at the first expansion corner being greater than 180°.

3. The baffle as set forth in claim 2 further comprising third and other ridges on the proximal exterior surface of the tubular body, the third and other ridges being constructed and arranged to define sequential compression and expansion corners.

4. The baffle as set forth in claim 3 wherein the proximal exterior surface has a generally frustoconical shape, having first diameter at a proximal end of the proximal exterior surface and a second diameter at a distal end of the proximal exterior surface, the second diameter being larger than the first diameter.

5. The baffle as set forth in claim 2 wherein the ridges are spaced apart from each other along the central axis at a substantially constant distance.

6. The baffle as set forth in claim 2 wherein the exterior angle of the proximal exterior surface at the first compression corner is between 120° and 160°.

7. The baffle as set forth in claim 6 wherein the exterior angle of the proximal exterior surface at the first expansion corner is between 200° and 240°.

8. The baffle as set forth in claim 1 wherein the second annular compression surface angles outward from the central axis of the tubular body from its proximal end to its distal end, the second annular compression surface being at a skew angle with respect to the central axis.

9. The baffle as set forth in claim 1 wherein the proximal exterior surface has the shape of a frustum of a cone.

10. The baffle as set forth in claim 9 wherein the tubular body comprises a proximal portion and a distal portion, the proximal portion including the first and second ridges.

11. The baffle as set forth in claim 10 wherein the distal portion is cylindrical in shape.

12. The baffle as set forth in claim 1 in combination with other baffles in a kit of baffles.

13. A suppressor for a firearm comprising:

an attachment portion configured for releasably attaching the suppressor to the firearm;

a sleeve supported by the attachment portion and extending distally from the attachment portion, the sleeve defining an internal volume; and a baffle assembly comprising a plurality of baffles, the baffle assembly at least partially received in the internal volume of the sleeve, the plurality of baffles arranged one after another, each of the baffles comprising a tubular body having a central axis, the tubular body being sized and shaped for receiving a bullet through the tubular body along the central axis from a proximal end of the tubular body to a distal end of the tubular body, the tubular body of at least one of the baffles including a proximal exterior surface and a plurality of annular ridges on the proximal exterior surface, the annular ridges being spaced apart from each other in a direction along the central axis of the tubular body, a first of the ridges comprising a first annular compression surface having a proximal end and a distal end, the first annular compression surface angling away from the central axis at an angle skew to the central axis as the first annular compression surface extends from its proximal end to its distal end, the first annular compression surface being positioned for direct exposure proximally around its circumference to gas entering the firearm suppressor from a firearm when the baffle is mounted in the firearm suppressor and the firearm suppressor is attached to the firearm, and a first annular expansion surface extending from a proximal end to a distal end, the proximal end of the first annular expansion surface and distal end of the first annular compression surface at least partially defining a first expansion corner, an exterior angle between the first annular compression surface and the first annular expansion surface at the first expansion corner being greater than 180°, a second of the ridges comprising a second annular compression surface extending from a proximal end to a distal end, the proximal end of the second annular compression surface and the distal end of the first annular expansion surface at least partially defining a first compression corner, an exterior angle between the second annular compression surface and the first annular expansion surface at the first compression corner being less than 180° whereby gas flowing along the proximal exterior surface of the tubular body of said at least one baffle is expanded at the first expansion corner and compressed at the first compression corner to dissipate energy in the flowing gas.

14. The suppressor as set forth in claim 13 wherein the second ridge of said at least one baffle further comprises a second annular expansion surface extending from a proximal end to a distal end, the proximal end of the second annular expansion surface and distal end of the second annular compression surface at least partially defining a second expansion corner, an exterior angle between the second annular compression surface and the second annular expansion surface at the first expansion corner being greater than 180°.

15. The suppressor as set forth in claim 14 wherein said at least one baffle further comprises third and other ridges on the proximal exterior surface of the tubular body, the third and other ridges being constructed and arranged to define sequential compression and expansion corners.

16. The suppressor as set forth in claim 15 wherein the proximal exterior surface of said at least one baffle has a generally frustoconical shape, having a first diameter at a proximal end of the proximal exterior surface and a second diameter at a distal end of the proximal exterior surface, the second diameter being larger than the first diameter.

17. The suppressor as set forth in claim 13 wherein the second annular compression surface of said at least one baffle angles outward from the central axis of the tubular body from its proximal end to its distal end, the second annular compression surface being at a skew angle with respect to the central axis.

18. The suppressor as set forth in claim 13 wherein the proximal exterior surface of said at least one baffle has the shape of a frustum of a cone.

19. The suppressor as set forth in claim 18 wherein the tubular body of said at least one baffle comprises a proximal portion and a distal portion, the proximal portion including the first and second ridges and the distal portion being cylindrical in shape.

20. The suppressor as set forth in claim 13 further comprising an end cap assembly located at a distal end of the suppressor.

21. The suppressor as set forth in claim 13 wherein the first annular compression surface extends from the proximal end of the tubular body.

22. The suppressor as set forth in claim 1 the first annular compression surface extends from the proximal end of the tubular body.

* * * * *